US011002130B2

(12) United States Patent
Fripp et al.

(10) Patent No.: US 11,002,130 B2
(45) Date of Patent: May 11, 2021

(54) DETERMINING DOWNHOLE PROPERTIES WITH SENSOR ARRAY

(71) Applicant: HALLIBURTON ENERGY SERVICES, INC., Houston, TX (US)

(72) Inventors: Michael Linley Fripp, Carrollton, TX (US); Thomas Jules Frosell, Irving, TX (US); Aswin Balasubramanian, Spring, TX (US); Luke William Holderman, Dallas, TX (US); Suzi Marie Marcuccio, Conroe, TX (US); Gireesh Bhat, Tomball, TX (US); Clint Adam Brown, Magnolia, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/755,440

(22) PCT Filed: Feb. 12, 2018

(86) PCT No.: PCT/US2018/017874
§ 371 (c)(1),
(2) Date: Feb. 26, 2018

(87) PCT Pub. No.: WO2018/160347
PCT Pub. Date: Sep. 7, 2018

(65) Prior Publication Data

US 2020/0224528 A1 Jul. 16, 2020

Related U.S. Application Data

(60) Provisional application No. 62/467,013, filed on Mar. 3, 2017, provisional application No. 62/467,019, filed
(Continued)

(51) Int. Cl.
*E21B 47/06* (2012.01)
*E21B 47/07* (2012.01)
(Continued)

(52) U.S. Cl.
CPC ..... *E21B 47/06* (2013.01); *E21B 33/12* (2013.01); *E21B 47/01* (2013.01); *E21B 47/07* (2020.05); *E21B 47/10* (2013.01)

(58) Field of Classification Search
CPC ..... E21B 47/06; E21B 47/07; E21B 33/12; E21B 47/01; E21B 47/10; E21B 47/11
See application file for complete search history.

(56) References Cited

U.S. PATENT DOCUMENTS 5,503,225 A * 4/1996 Withers ..... B09B 1/008 166/250.1
6,131,658 A * 10/2000 Minear ..... E21B 47/14 166/250.01

(Continued)

OTHER PUBLICATIONS

International Search Report and Written Opinion; PCT Application No. PCT/US2018/017874; dated May 25, 2018.

*Primary Examiner* — Michael R Wills, III
(74) *Attorney, Agent, or Firm* — Polsinelli PC

(57) ABSTRACT

A spoolable array of sensors may be deployed within a wellbore and external a tubular string for measuring properties of a fluid in the central flow passage of the tubular string. A flow port may be made in the tubular string passing from the central flow passage to the external surface. Sensors of the spoolable array of sensors may be covered with a shroud and placed proximate the flow port, or such sensors may be isolated in a zone with packers along with the flow port. The spoolable array of sensors may additionally obtain pressure data to calculate a flow rate from a production zone. The spoolable array of sensors may also be employed in a non-flowing wellbore for monitoring nearby wellbores.

29 Claims, 10 Drawing Sheets

Related U.S. Application Data on Mar. 3, 2017, provisional application No. 62/467,029, filed on Mar. 3, 2017, provisional application No. 62/467,026, filed on Mar. 3, 2017.

(51) Int. Cl.

| | |
|---|---|
| ***E21B 33/12*** | (2006.01) |
| ***E21B 47/01*** | (2012.01) |
| ***E21B 47/10*** | (2012.01) |

(56) References Cited

U.S. PATENT DOCUMENTS

| | | | | |
|---|---|---|---|---|
| 2002/0064206 | A1 | 5/2002 | Gysling et al. | |
| 2004/0154390 | A1 | 8/2004 | Baustad | |
| 2006/0016595 | A1 | 1/2006 | Rioufol et al. | |
| 2007/0227727 | A1* | 10/2007 | Patel | E21B 43/14 166/250.01 |
| 2008/0185144 | A1 | 8/2008 | Lovell | |
| 2008/0201080 | A1* | 8/2008 | Lovell | G01F 1/684 702/12 |
| 2009/0008078 | A1 | 1/2009 | Patel | |
| 2009/0066535 | A1* | 3/2009 | Patel | E21B 43/14 340/853.2 |
| 2009/0114386 | A1* | 5/2009 | Hartog | E21B 43/26 166/250.08 |
| 2010/0101786 | A1* | 4/2010 | Lovell | E21B 17/028 166/250.01 |
| 2018/0223648 | A1* | 8/2018 | Wilson | E21B 47/10 |

* cited by examiner

DETERMINING DOWNHOLE PROPERTIES WITH SENSOR ARRAY

CROSS-REFERENCE TO RELATED APPLICATIONS

The present application claims the benefit of U.S. Provisional Application No. 62/467,013, filed Mar. 3, 2017, U.S. Provisional Application No. 62/467,019, filed Mar. 3, 2017, U.S. Provisional Application No. 62/467,029, filed Mar. 3, 2017, and U.S. Provisional Application No. 62/467,026, filed Mar. 3, 2017, each of which is hereby incorporated by reference in its entirety.

TECHNICAL FIELD

The present technology is directed to downhole sensors. In particular, the present technology involves an array of sensors provided within a wellbore for determining various downhole properties.

BACKGROUND

Wellbore completion involves preparing a well for hydrocarbon production after drilling operations have been conducted. During the completion phase, production tubing may be provided downhole for injecting various fluids or withdrawing hydrocarbons. Stimulation processes may have also been conducted including perforating or creating fractures in the formation. During completion processes, packers may be provided to isolate various zones along the length of the tubing. These zones may isolate particular areas to facilitate production of hydrocarbon from the fractured portions of the formation.

During the completion phases, it may become desirable to measure properties of the fluid, formation, or tubing downhole. Accordingly sensors may be provided downhole at various points of the tubing to collect data for processing.

Furthermore, oilfields may contain multiple wells at various stages. Some wells may be currently drilled, under stimulation or completion, non-producing, non-flowing, or abandoned.

BRIEF DESCRIPTION OF THE DRAWINGS

The examples herein may be better understood by referring to the following description in conjunction with the accompanying drawings in which like reference numerals indicate analogous, identical, or functionally similar elements. Understanding that these drawings depict only examples of the disclosure and are not therefore to be considered to be limiting of its scope, the principles herein are described and explained with additional specificity and detail through the use of the accompanying drawings in which.

DETAILED DESCRIPTION

Figure 1:
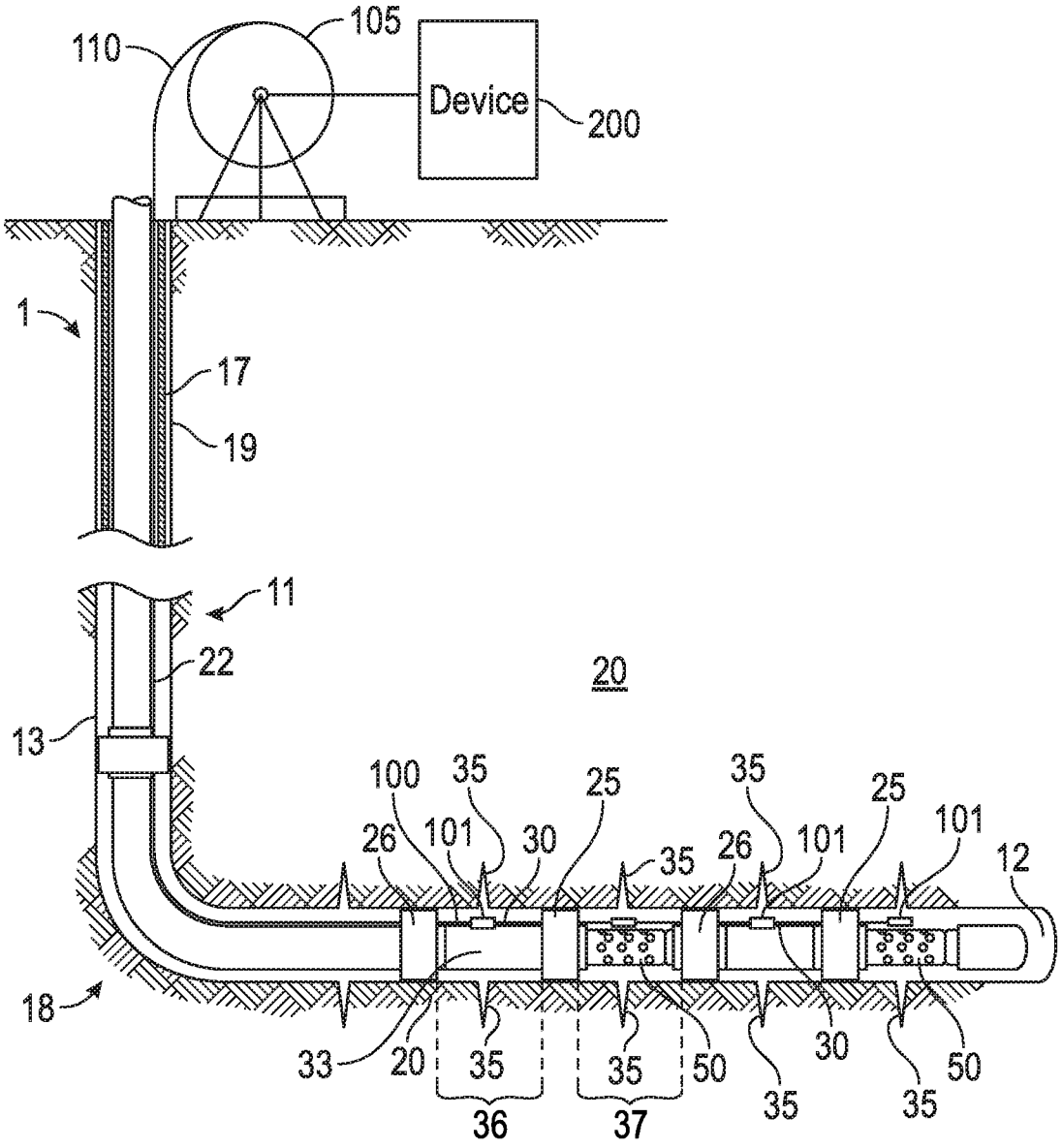
FIG. 1 is a schematic diagram of a tubular string provided in a wellbore for completion processes.

Various examples of the disclosure are discussed in detail below. While specific implementations are discussed, it should be understood that this is done for illustration purposes only. A person skilled in the relevant art will recognize that other components and configurations may be used without parting from the spirit and scope of the disclosure. Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

Disclosed herein is a spoolable array of sensors having a plurality of connected sensors for placement in a wellbore. The plurality of sensors may be connected via a line such as a tubing encased conductor (TEC). The spoolable sensory array maybe deployed along with a tubular string into a wellbore for measuring properties of a downhole fluid such as pressure, temperature, or flow rate. The array of sensors can be coupled to the tubular string. In some examples, the array of sensors is coupled to the exterior of production tubing. The array of sensors can be coupled to the tubular string through clamps, straps, or other external affixing devices. In some instances, the plurality of sensors may only measure pressure or only measure temperature. In other examples, the sensor can be a combination pressure and temperature sensor. The measurement of the pressure and temperature can be used for a variety of applications which employ tubular strings in the wellbore, such as completion, stimulation, or other processes. In such processes, such as completion, the wellbore has been divided into multiple production zones with the use of packers.

As provided herein, the array of sensors may be employed to measure properties of fluids or materials within the tubular string while being outside the surface of the tubular string. In order to measure the properties of fluids within the tubular string, a flow port, also referred to as a passage, can be machined or otherwise provided in the tubing. The flow port may extend from the central flow passage of the tubular to the external surface. In at least one example, the flow port can be formed as the tubing is installed in the wellbore. A pup joint with a flow port formed therein can also be installed. When using a pup joint, the flow port can be pre-formed to allow for rapid assembly and flexibility in location of the passage.

One or more of the plurality of sensors of the spoolable array may be placed proximate this flow port sufficient to measure a property of the fluid inside the tubular, whether fluid is flowing into or out from the flow port. The term "proximate" as used herein refers to the sensor being close enough to the property communication port sufficient to detect a property of the internal fluid within the central flow passage, which may be several inches or less than 1 or 2 feet, directly touching the property communication port, or within a chamber, enclosure or containment formed by the shroud. A pair of zonal isolation packers can be employed with the tubular string to isolate a production zone. A secondary packer may be provided between the pair of zonal isolation packers in the same area as the flow port. The secondary packer forms a sensor zone having a sensor of the spoolable sensor array and the flow port on one side of the secondary packer, and the production zone on the opposite side of the secondary packer. Alternatively or additionally, the location of the at least one secondary packer can be such that it is placed over a flow regulator (a flow regulator may be an inflow control device (ICD), autonomous inflow control device (AICD), inflow control valve (ICV), choke, nozzle, baffle, restrictor, tube, valve, etc.). The location of the secondary packer is configured to allow fluid communication between fluid in the annulus and within the central flow passage of the tubular string without exposure to fluid in the production zone. The location of the sensor can be such that it is isolated from the production zone by the secondary packer.

Alternatively, or in addition to, using the zonal isolation packers and/or secondary packers, a shroud may be used to position sensors from the spoolable sensor array near the flow port. In particular, a shroud (or housing) may be provided forming a pressure barrier between the pressure sensor and the flow port into the central flow passage of the tubular string, and the fluid in the annulus. The pressure is communicated from the interior of the completion string, through the flow port (which may be a hole or aperture), into the shroud, and to the pressure sensor on the sensor array. Accordingly, in practice, the flow port may be formed by deliberately making a hole in the tubing and then covering, immediately or otherwise, that hole with a shroud.

As disclosed herein the shroud provides some flexibility, as otherwise precise control of the layout of the tubular string in order to achieve the exact alignment of the sensor and the machined sensor port would be required. Such alignment would otherwise be difficult because the tubular string has variable length and the sensor array has limited ability to stretch.

The spoolable sensor array disclosed herein may also be used to measure flow rate from a production zone in the tubular string and annulus. The method can be configured to obtain measurement of fluid properties in the tubular string and an annulus. In the deployment of the tubular string and spoolable sensor array, at least one pair of zonal isolation packers can be used to create a production zone. At least two of the plurality of sensors are located within the production zone. A first one of the at least two of the plurality of sensors can be located upstream from a flow regulator, and a second one of the at least two of the plurality of sensors can be located downstream from the flow regulator. The method can also include receiving first pressure data, at a processor, from the first one of the at least two of the plurality of sensors. Additionally, the method can include receiving second pressure data, at the processor, from the second one of the at least two of the plurality of sensors. Furthermore, the method can include determining, at the processor, a differential pressure based on a difference between the first pressure data and the second pressure data. The method can calculate, at the processor, a fluid flow rate from the production zone based on the differential pressure.

The method can further include deploying the first sensor on a screen. The method can include deploying an additional flow regulator that is downstream of the initial flow regulator and having a third sensor deployed downstream of the additional flow regulator.

Further to the above, the spoolable array of sensor may be employed to measure properties within a wellbore without a tubular string, for instance the spoolable array of sensors may be used to measure the pressure profile in a non-flowing wellbore. In this case, the array may be used to monitor the stimulation treatments in nearby wellbores. Accordingly, the array may be placed in a monitoring wellbore with no production flow. Therefore, all of the pressure variations can be attributed to the effects from the stimulation treatments in the nearby wellbores.

FIG. 1 is a schematic diagram depicting an environment in which the present disclosure may be implemented. The environment 1, in this case a completion, includes a tubular string 22 for use in completion and stimulation of formation. The terms stimulation and injection, as used herein, include fracking, acidizing, hydraulic work and other work-overs. The tubular string 22 may be made up of a number of individual tubulars, also referred to as sections or joints. The sections can include multiple such assemblies as well as blank tubing, perforated tubing, shrouds, joints, etc., as are known in the industry. Each tubular of the tubular string 22 may have a central flow passage an internal fluid and an external surface. The phrase "tubular" may be defined as one or more types of connected tubulars as known in the art, and can include, but is not limited to, drill pipe, landing string, tubing, production tubing, jointed tubing, coiled tubing, casings, liners, combinations thereof, or the like.

A wellbore 13 extends through various earth strata. Wellbore 13 has a substantially vertical section 11, the upper portion of which has installed therein casing 17 held in place by cement 19. Wellbore 13 also has a substantially deviated section 18, shown as horizontal, which extends through a hydrocarbon bearing subterranean formation 20. As illustrated, substantially horizontal section 18 of wellbore 13 is an open hole 12, such that there is not a casing. It is understood that the wellbore may be cased or open, vertical, horizontal, or deviated, etc.

Zonal isolation packers 26 straddle target zones of the formation 20. The packers 26 isolate the target zones which may have fractures 35 for stimulation and production. The packers 26 may be swellable packers, however, they may be other types of packers as are known in the industry, for example, slip-type, expandable or inflatable packers. Additional downhole tools or devices may also be included on the work string, such as valve assemblies, for example at valve, safety valves, inflow control devices, check valves, etc. The tubing sections between the packers 26 may include sand screens 50 to prevent the intake of particulate from the formation as hydrocarbons are withdrawn.

As shown, an array of sensors 100 is spoolable from spool 105. The array of sensors 100 is shown as having a line 110 which connect each of the individual sensors 101. Data from the sensors 101 may be transmitted along the line 110 and provided to one or more processors at the surface, such as device 200 discussed further below. The line 110 may be a cord, line, metal, and may be conductive and permit power and data to transfer over the line 110 between each of the sensors 101 and to the surface. The line 110 may be sufficiently ductile to permit spooling and some amount of bending, but also sufficiently rigid to hold a particular shape in the absence of external force.

The array of sensors 100 as disclosed herein may measure at least one of temperature, pressure, or any other suitable property. The sensors 101 can be any number of different types of sensors. In at least one example, the sensor can be a combination pressure and temperature sensor. The sensor can be a resonance-based pressure sensor, or a strain-based pressure sensor. The resonance-based pressure sensor, like a quartz pressure sensors, measure the frequency change in an oscillator as the hydrostatic pressure changes. A strain-based pressure sensor measures the deflection of a structure due to a pressure differential between hydrostatic pressure and an air chamber.

The sensor array can be a spoolable construction that is a pre-welded assembly attached to the exterior of the completion string with fasteners such as mechanical clamps, bands, or clips.

A completion is divided into production zones with the use of packers 26. The production flow comes from the formation, through a screen, through a flow regulator (ICD, AICD, ICV, choke, nozzle, baffle, restrictor, tube, valve, et cetera), and into the interior of the tubing.

As disclosed herein a flow port 30 is formed in the tubular string. A secondary packer 25 is located between zonal isolation packers 26. The secondary packer 25 forms a production zone 37 that does not include the flow port 30 and a sensor zone 36 that does include the flow port 30. A sensor 101 is located within the sensor zone 36 and another sensor 101 is located in the production zone 37. The sensor 101 that is located within the sensor zone 36 is configured to measure fluid properties within the central flow passage 33. Thus, at least one of the plurality of sensors 101 is located on either side of the at least one secondary packer 25. As illustrated, there are two secondary packers 25.

As illustrated there can be one or more production zones 37 and one or more corresponding sensor zones 36. In at least one example, there is one secondary packer 25 that corresponds with each production zone 37, so that there is at least one sensor zone 36 for every production zone 37. In other examples, there can be multiple sensor zones 36 for each production zone 37.

Figure 2:
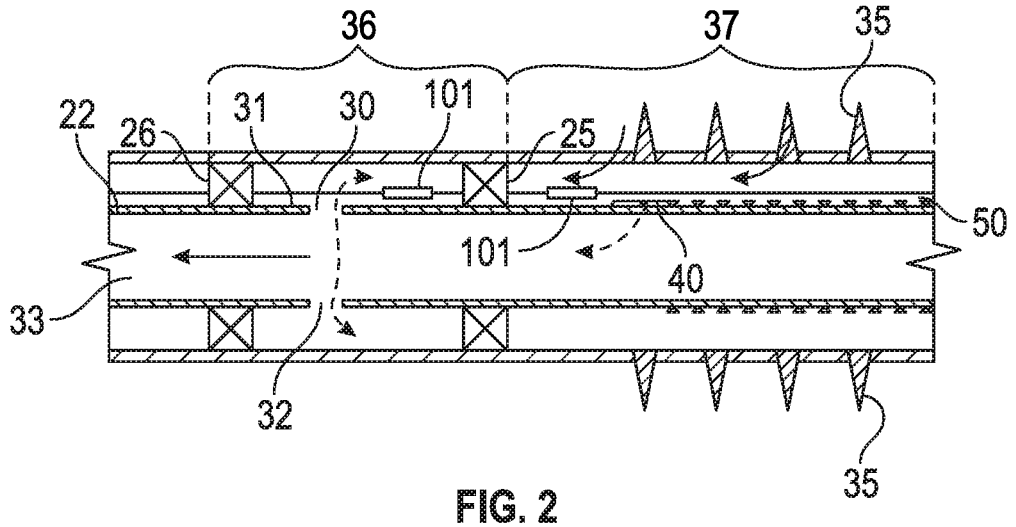
FIG. 2 is a schematic cross-sectional view of an example tubular string having a plurality of sensors coupled to the tubular string.

FIG. 2 is a schematic cross-sectional view of an example schematic of a tubular string according to the present disclosure. As illustrated there are two flow ports 30, 32 that are formed within the tubular string 22. In other examples, there may be one, two, or more than two flow ports formed within the tubular string 22. The flow ports 30, 32 may also be referred to herein as a property communication port, or sensor port. As illustrated, flow ports 30, 32 are opposite one another in the tubular string 22. In other examples, flow ports 30, 32 can be positioned along the tubular string 22 as desired. Production fluid can flow through the fractures 35 (which maybe perforations) and through the screen 50 into the central flow passage 33, and then flows out of the flow ports 30, 32. In at least one example, a screen 50 may not be provided.

The tubular string 22 has a sensor zone 36 in which the tubular string 22 forms flow ports 30, 32 through an exterior surface 31 between one of the pair of zonal isolation packers 26 and the secondary packer 25. An external surface 31 as used herein refers to the outer surface of the tubular string 22 that is away from the central flow passage 33. One of the plurality of sensors 101 is located within the sensor zone 36 and is operable to detect properties of the fluid within the central flow passage 33. In at least one example, the plurality of sensors 101 can be located beyond the external surface 31. As illustrated, the plurality of sensors 101 can be located in the annulus formed between the external surface 31 and the casing, borehole, or surrounding tubing. As illustrated, the one of the plurality of sensors 101 can be located substantially close, i.e., proximate, to the flow ports 30, 32. As used herein, substantially close refers to a distance that allows for the fluid to easily flow from the flow ports 30, 32 to the one of the plurality of sensors 101. In at least one example, the one of the plurality of sensors 101 can be located within less than an inch of the flow ports 30, 32. In other example, the one of the plurality of sensors 101 can be located between one to fifteen inches from the flow ports 30, 32. In another example, the one of the plurality of sensors 101 can be located over the flow ports 30, 32. The term "over" refers to being radially outward from the passage in approximately the same axial position as the passage. In at least one example being "over" means that the packer is not further uphole or downhole from the passage.

Figure 3:
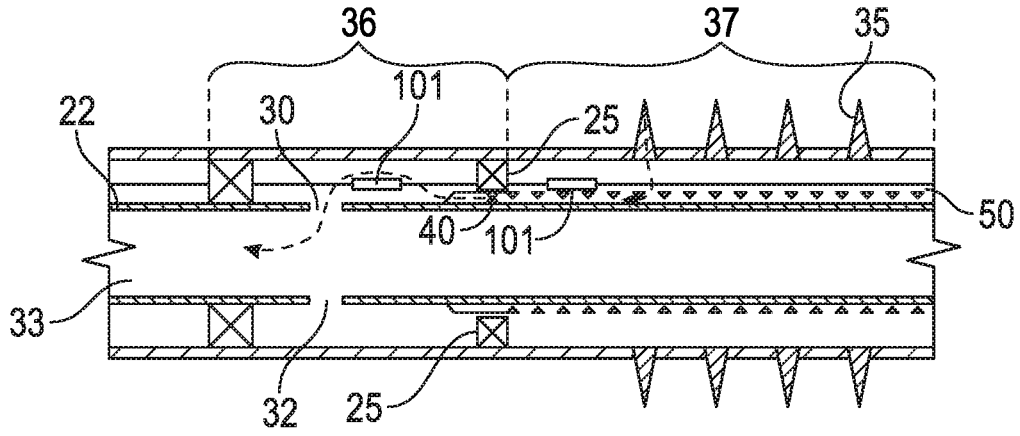
FIG. 3 is a schematic cross-sectional view of another example of a tubular string having a plurality of sensors coupled to the tubular string.

FIG. 3 is a schematic cross-sectional view of another example of a tubular string having a plurality of sensors 101 coupled to the tubular string. The secondary packer 25 as illustrated is located over a flow regulator 40. The flow regulator 40 can be one of an ICD, AICD, ICV, choke, nozzle, baffle, restrictor, tube, or valve. As illustrated by the dotted arrow in FIG. 3, the flow from the production zone 37 flows past one of the plurality of sensors 101 into a screen 50. Various suitable sand screens include wire mesh, wire wrap screens, perforated or slotted pipe, perforated shrouds, porous metal membranes, or other screens which permit the flow of desirable fluids such as hydrocarbons and filter out and prevent entry of undesirable particulates such as sand. The flow of the fluid is then directed through a flow regulator 40. The production zone 37 is isolated from the sensor zone 36 by the secondary packer 25. The fluid then flows past a sensor 101 that is located in the sensor zone 36 into one of the flow ports 30, 32. While two flow ports are illustrated, the present disclosure can include a plurality of flow ports or a single flow port.

The sensor 101 that is located in the production zone 37 is configured to measure fluid properties in the annulus formed between the tubular string 22 and the casing 17. One of plurality of sensors 101 is located within a sensor zone 36 and measures properties of flow of fluid through the flow regulator 40 into the flow ports 30, 32. Due to the flow ports 30, 32, the pressure in the annulus in zone 36 is substantially the same as within the central flow passage 33 of the tubular string 22.

Figure 4:
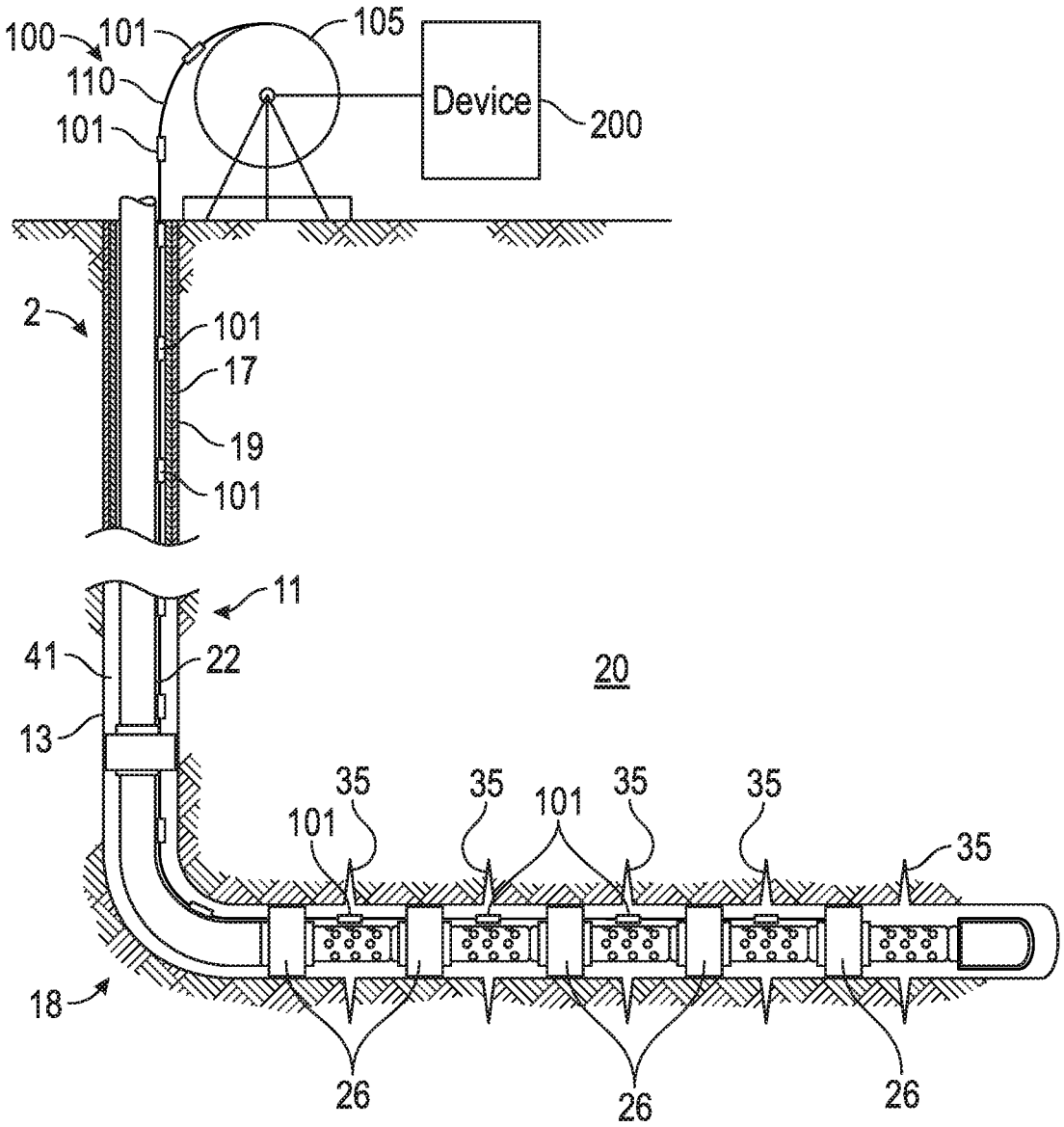
FIG. 4 is a schematic diagram of a tubular string provided in a wellbore for completion processes.

Whereas FIGS. 1-3 illustrate isolating flow ports 30, 32 via packers, such flow ports may also be isolated by the use of shrouds. FIG. 4 is a schematic diagram depicting a completion 2 in which the present disclosure may be implemented. Reference numerals in FIG. 4 repeated from FIG. 1 refer to the same features. In FIG. 4, the completion 2 includes a tubular string 22 for use in completion and stimulation of the formation, and an annulus 41. Packers 26 straddle target zones of the formation. The packers 26 isolate the target zones for stimulation and production which may include fractures 35. An array of sensors 100 is spoolable from spool 105. The array of sensors 100 is shown as having a line 110 which connect each of the individual sensors 101.

Figure 5:
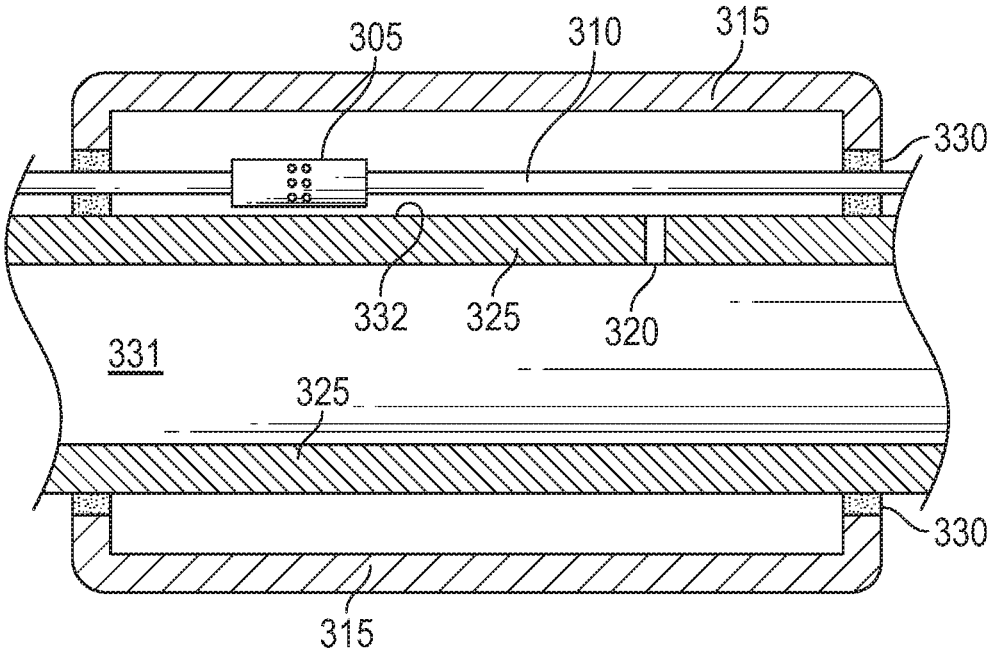
FIG. 5 is a schematic diagram of a tubular string with a shroud for a sensor and flow port.

With respect to the tubular string 22, a flow port, also referred to herein as a property communication port or sensor port, is added to the completion tubing and a shroud is provided around the sensor 101 (such as pressure or temperature sensor) on the sensor array 100. This concept is shown FIG. 5, which is a schematic diagram illustrating a shroud (or cover) 315 used to cover both a sensor 305, which may be a pressure gage or temperature sensor, and a flow port 320. While FIG. 5 illustrates one flow port 320, the tubular string can include more than one flow ports 320. The sensor 305 may be a pressure gauge or temperature sensor for instance. The flow port 320 may be a hole or aperture. The flow port 320 extends between a central flow passage 331 for passage of an internal fluid and an external surface 332. The shroud 315 covers the sensor 305 of the array of sensors 100 and covers the flow port 320 in the tubular 325, which is illustrated in FIG. 5 as completion tubing. The flow port 320, or hole, allows interior pressure to be communicated to the annular region of the sensor zone, which is captured within the shroud 315. A seal 330 permits the line 310, which may be a TEC, to pass into the shroud 315 while preventing the inflow or outflow of fluid with the annulus. Accordingly, fluid, pressure, or temperature may be transferred or communicate across or through the flow port 320 to outside the tubular 325 within the shroud 315, without mixing with the fluid from the annulus. Thus, a sensor 305 of the array of sensors 100 within the shroud 315 can sense the interior pressure or temperature while being located on the exterior of the tubular 325.

Figure 6:
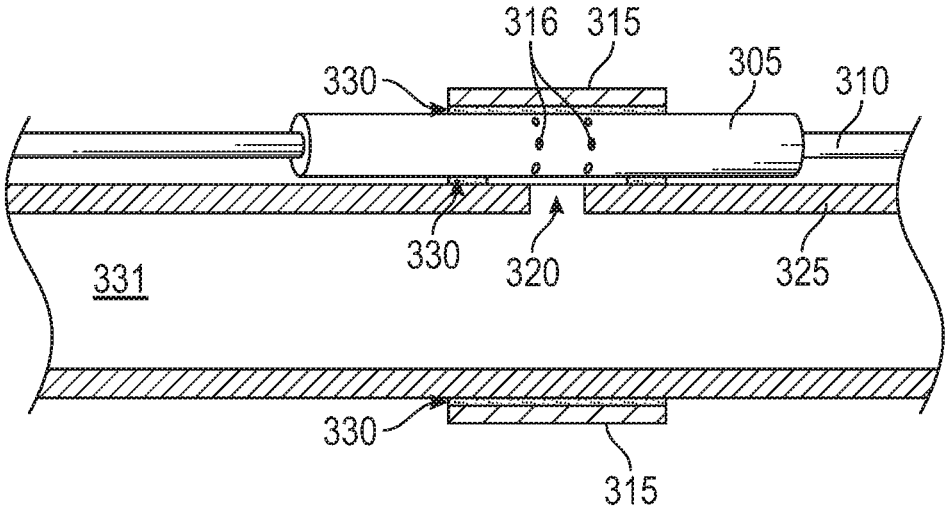
FIG. 6 is a schematic diagram of a tubular string with a short shroud for a sensor and flow port.

In the concept shown in FIG. 5, the shroud 315 is much longer than the sensor 305. This allows the flow port 320 in FIG. 5 to be pre-machined in the tubular 325 (e.g., the base pipe, or other tubular) and for the array of sensors 100 to be a pre-welded assembly. The length of the shroud 315 also accommodates space-out uncertainties. In another variation, the flow port 320 is not pre-machined. Thus, the flow port 320 can be placed proximate the sensor 305. In this variation, shroud 315 can be short (for example, shorter than the length of the sensor 305). This concept is illustrated in FIG. 6, which is a schematic diagram of a shroud 315 wrapped around the sensor 305 and which is shorter in length than the length of sensor 305. The sensor 305 is placed over or sufficiently proximate to the flow port 320 in tubular 325 so as to contact or detect the fluid within the central flow passage 331 of tubular 325. The shroud 315 has a seal 330 which may be placed along or around the sensor 305 and the tubular 325 so that fluid passing through the flow port 320 remains within the shroud 315 and prevents fluid flow from the annulus and mixture with fluid from the annulus. The seal 330 therefore seals the portion of the sensor 305 which detects the fluid property to contact fluid from the flow port 320 rather than annulus fluid. For instance, the sensor 305 may have one or more detection ports 316 in a small area of the sensor 305. The detection ports 316 may be contained within the shroud 315 and seal 330 so as to be in fluidic communication with and detect properties of the fluid flowing from the flow port 320, without contamination from the fluids in the annulus.

Figure 7:
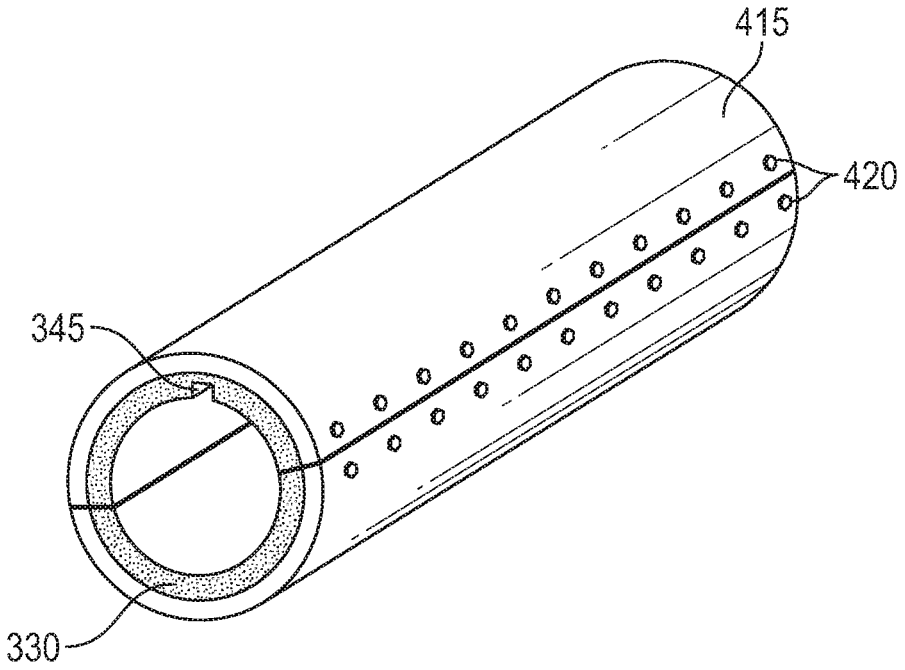
FIG. 7 is a schematic diagram of a tubular string with a two part shroud.

There are multiple methods for creating the shroud 415. FIG. 7 is a schematic diagram illustrating a two-part shroud 415. The two-parts of the shroud 415 may be connected with a fastener 420, such as bolts, hinges, pins, welding, bonding, adhesive, magnets, or any suitable fastener. In FIG. 7, the shroud 415 is illustrated as a clamp that uses a pin to hold it closed. The concept may be employed with, for instance, the Cross Coupling Clamp sold by Cannon. Additionally, a seal 330 is further provided to the design to seal the sensor and flow port from fluid in the annulus and create fluid communication, including pressure communication, between a sensor on the array and a flow port into the interior of the tubing. A passthrough 345 may be provided in the seal 330 for a line 110 of an array of sensors 100.

Figure 8:
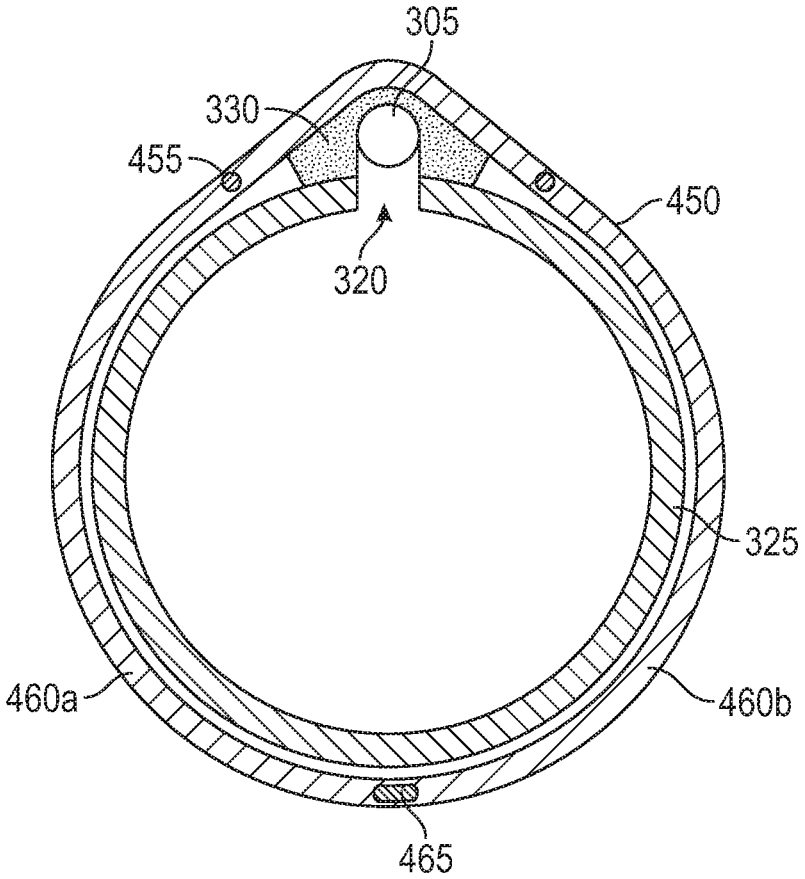
FIG. 8 is a schematic diagram of a tubular string with a shroud having a clamp.

FIG. 8 is a schematic diagram illustrating a cross-sectional view of a shroud 450 which is illustrated in FIG. 8 as a clamp, such as the Cross Coupling Clamp commercially available by Cannon. The shroud 450 has a hinge 455 with claws 460*a* and 460*b* which wrap around the tubular 325, and are held together by a fastener 465, which is illustrated as a pin, which holds the shroud 450 closed. Accordingly, the shroud is 450 is illustrated as a clamp that uses a fastener 465 to hold it closed.

The array of sensors disclosed herein may alternate between shrouded sensors as disclosed in FIGS. 5-8 and conventional unshrouded sensors. Accordingly, the array of sensors 100 of FIG. 1 may include a plurality of sensors as described according to FIGS. 5-8, as well as conventional sensors conventional sensors without the shroud, and may be arranged to alternate between the one and the other. Moreover, the shrouded and unshrouded sensors may be interleaved in any order to meet the sensing requirements of the sensor array.

Further to the above, the array of sensors disclosed herein may be employed to measure properties of fluids or materials in the tubular string and an annulus to determine flow rate from a production zone, within the annulus and/or tubular string. The annulus is formed between the exterior of a tubular string and the surface of the borehole or casing. The method includes deploying the tubular string and spoolable sensor array in the wellbore. The array of sensors may be run on the exterior of the production tubing. In the deployment of the tubular string and spoolable sensor array, at least one pair of zonal isolation packers can be used to create a production zone. At least two of the plurality of sensors are located within the production zone.

A first one of the at least two of the plurality of sensors can be located upstream from a flow regulator, and a second one of the at least two of the plurality of sensors can be located downstream from the flow regulator. The method can also include receiving first pressure data, at a processor, from the first one of the at least two of the plurality of sensors. Additionally, the method can include receiving second pressure data, at the processor, from the second one of the at least two of the plurality of sensors. Furthermore, the method can include determining, at the processor, a differential pressure based on a difference between the first pressure data and the second pressure data. The method can calculate, at the processor, a fluid flow rate from the production zone based on the differential pressure.

In additional examples for determining flow rate, the method includes deploying a tubular string within a wellbore, the tubular string having a central flow passage and an external surface, at least one tubular of the tubular string having a flow port (also referred to as a flow passage) formed therein. The method further includes deploying a spoolable sensor array, comprising a plurality of sensors, along with the deployment of the tubular string, wherein the spoolable sensor array is coupled to the tubular string during deployment. The method can also include deploying a plurality of pairs of zonal isolation packers to isolate a corresponding number of production zones, wherein at least two of the plurality of sensors are located within the production zones. The at least two of the plurality of sensors comprise a first sensor being located upstream from an initial flow regulator and a second sensor being located downstream from the initial flow regulator. The method can further include deploying the second sensor to have a fluidic coupling to the initial flow regulator.

The method can further include deploying the first sensor on a screen. The method can also include deploying an additional flow regulator that is downstream of the initial flow regulator and having a third sensor deployed downstream of the additional flow regulator.

The method can further include receiving first pressure data, at a processor, from the first sensor in a respective one of the plurality of production zones. The method can further include receiving second pressure data, at the processor, from the second sensor in a respective one of the plurality of production zones. Additionally, the method can include receiving third pressure data, at the processor, from the third sensor in a respective one of the plurality of production zones. Furthermore, the method can include determining, at the processor, a first differential pressure based on the difference between the first pressure data and the second pressure data. The method can also include determining, at the processor, a second differential pressure based on a difference between the second pressure data and the third pressure data. The method can calculate, at the processor, a fluid flow rate from the corresponding production zone based on first differential pressure and the second differential pressure. In at least one example, the method can obtain first pressure data, second pressure data, and third pressure data substantially simultaneously. As used herein substantially simultaneously can include within one second, with one minute or within one hour. In at least one example, substantially simultaneously can be within one second or less.

A flow port can be machined or otherwise provided in the tubing. In one example, the flow port can be a part of a flow regulator.

Figure 9:
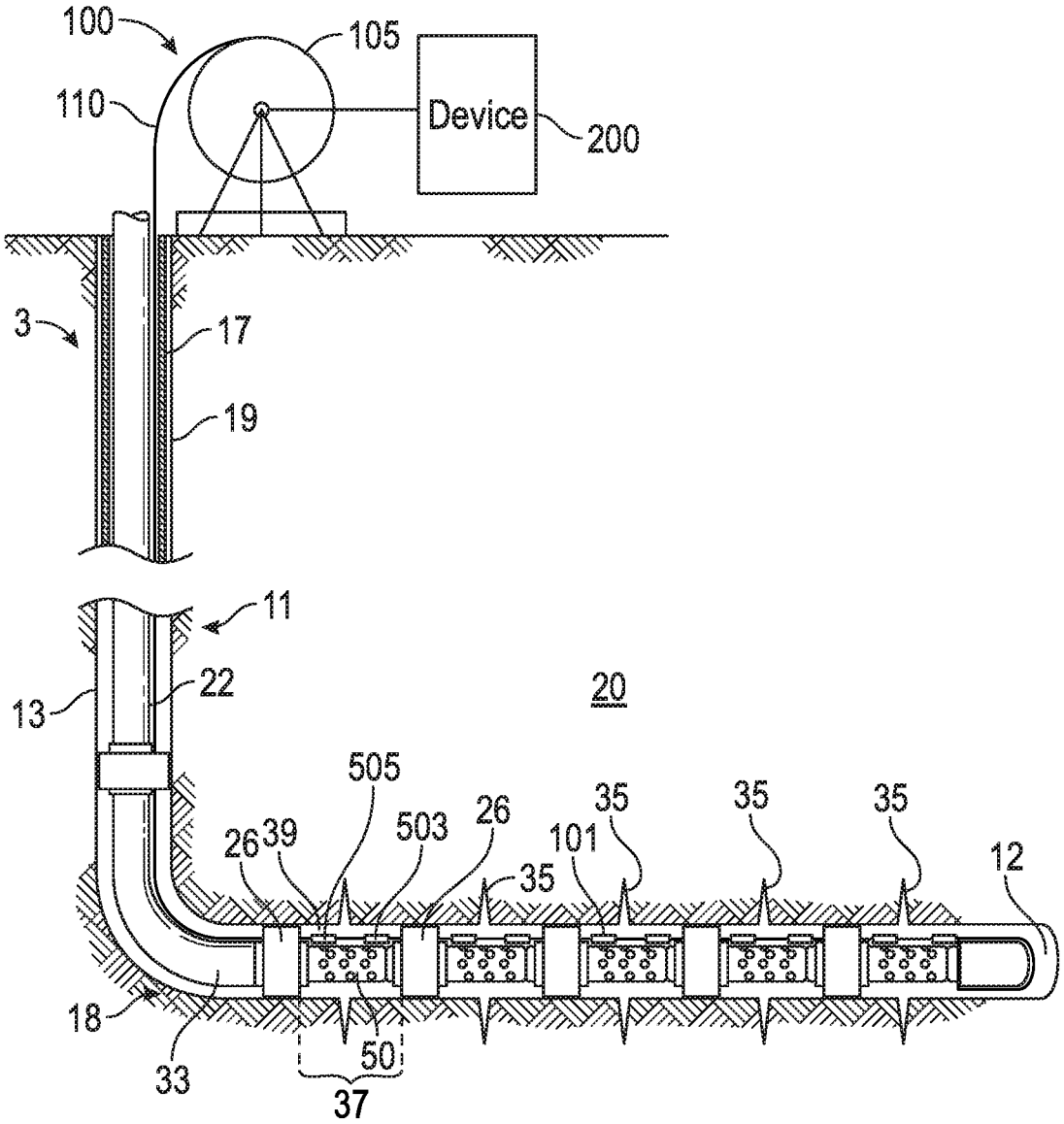
FIG. 9 is a schematic diagram of a tubular string provided in a wellbore for completion processes.

FIG. 9 is a schematic diagram illustrating an environment in which the present disclosure may be implemented for determining the flow rate in a production zone. The environment, in this case a completion is indicated generally as 3, including a tubular string 22 for use in completion and stimulation of formation, and an annulus 39. Reference numerals in FIG. 9 repeated from FIG. 1 refer to the same features.

Zonal isolation packers 26 straddle target zones of the formation. The packers 26 isolate the target zones for stimulation and production and which may have fractures 35. The packers 26 may be swellable packers, however, they may be other types of packers as are known in the industry, for example, slip-type, expandable or inflatable packers. Additional downhole tools or devices may also be included on the work string, such as valve assemblies, for example at valve, safety valves, inflow control devices, check valves, etc. The tubing sections between the packers 26 may include sand screens 50 to prevent the intake of particulate from the formation as hydrocarbons are withdrawn.

As illustrated, the tubular string 22 includes at least one pair of zonal isolation packers 26 that are operable to be coupled to tubular string 22. As shown there are at least two of the plurality of sensors 101 located between a corresponding pair of the at least one pair of zonal isolation packers 26. A first sensor 503 is located upstream of an initial flow regulator and a second sensor 505 that is located downstream of the initial flow regulator. The first sensor 503 and second sensor 505 may be pressure sensors, wherein the differential in pressure information may be used for determining flow rate in a production zone.

Figure 10:
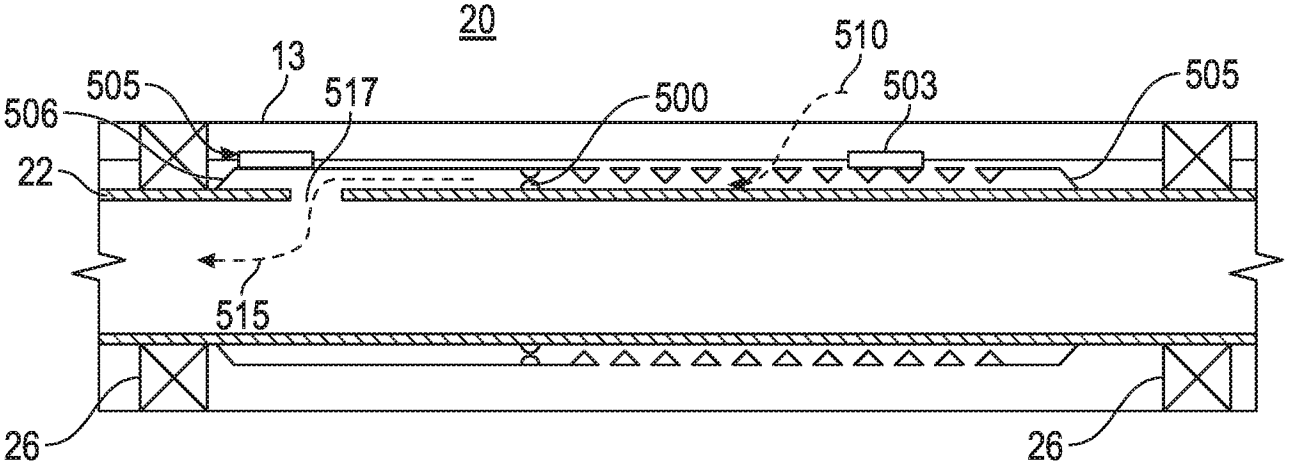
FIG. 10 is a schematic cross-sectional view of an example tubular string having a plurality of sensors coupled to the tubular string.

FIG. 10 is a schematic cross-sectional view of a tubular string 20 according to the present disclosure illustrating an initial flow regulator 500 along with a screen 505 in a production zone isolated by packers 26. The flow regulator 500 can be an ICD, AICD, ICV, choke, nozzle, baffle, restrictor, tube, or valve. As illustrated a first sensor 503 is located upstream of the initial flow regulator 500 and on or proximate the screen 505. The second sensor 505 is illustrated downstream of the initial flow regulator 500, and may detect the pressure of the fluid after passing through the initial flow regulator 500. For instance, the second sensor 505 may be coupled with a housing 506 or shroud of the initial flow regulator 505. Flow arrow 510 illustrates fluid entering into the wellbore 13 from formation 20. The fluid then passes through the screen 505, through the initial flow regulator 500. The flow arrow 515 illustrates the fluid passing through the initial flow regulator 500 and into the tubular string 22 through flow port 517. A differential pressure may be determined based on a difference between pressure data from the first sensor 503 and pressure data from the second sensor 505. The flow rate from the production zone, and inside the tubular 22 can be determined based on the differential pressure.

Figure 11:
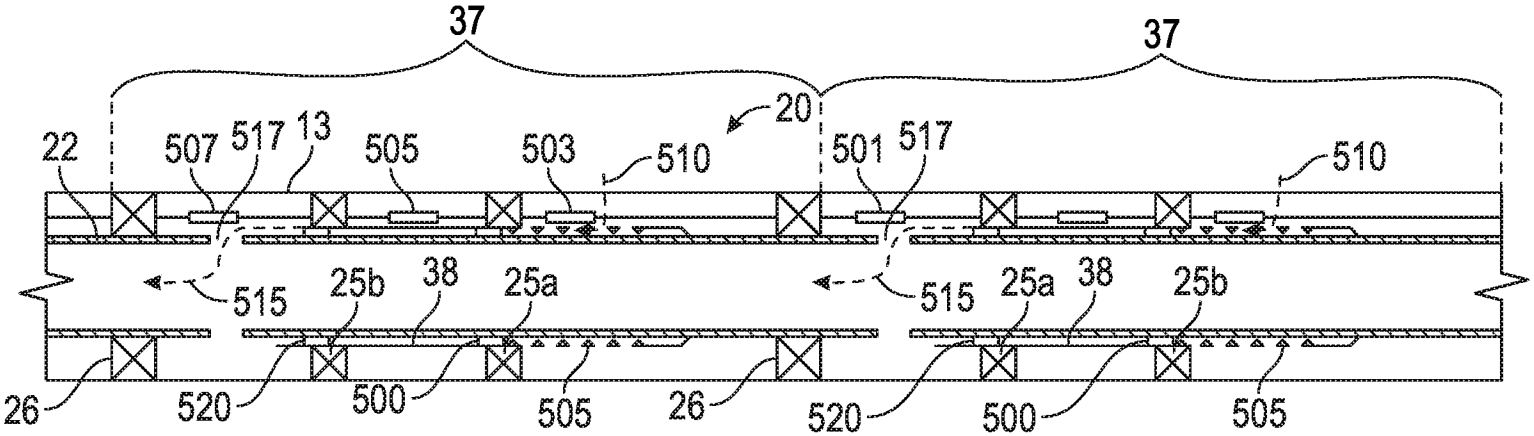
FIG. 11 is a schematic cross-sectional view of another example of a tubular string having a plurality of sensors coupled to the tubular string.

FIG. 11 is a schematic cross-sectional view of a tubular string 20 according to the present disclosure illustrating an additional method of determining flow rate in a production zone. FIG. 11 differs from FIG. 10 in that FIG. 11 illustrates two production zones formed by packers 26 as well as an additional flow regulator 520. The additional flow regulator 520 is located between the same pair of zonal isolation packers 26. In addition to the first sensor 503 and the second sensor 505, the plurality of sensors further includes a third sensor 507, which may be a pressure sensor, temperature sensor, or any suitable sensor. The third sensor 507 is located downstream of the additional flow regulator 520. The additional flow regulator 520 is one of an ICD, AICD, ICV, choke, nozzle, baffle, restrictor, tube, or valve. The initial flow regulator 500 and the additional flow regulator 520 may have different flow resistances.

Secondary packers 25*a* and 25*b* may be placed between the one pair of zonal isolation packers 27 to isolate an intermediate zone 38. The second flow sensor 505 may be arranged in an intermediate position in this intermediate zone 38 between two secondary packers 25*a* and 25*b*. The initial flow regulator 500 may be arranged beneath the secondary packer 25*a*, and the additional flow regulator 520 arranged beneath the secondary packer 25*b*. Accordingly, production fluid may flow as shown by flow arrow 510 from the formation 20 through the screen 505 and then through the initial flow regulator 510 in to the intermediate zone 38. The fluid then passes through the additional flow regulator 520 and through the flow port 517 into tubular 22 as shown by flow arrow 515. The third sensor 507 may be arranged between the zonal isolation packer 26 and the secondary packer 25*b* also having the flow port 22.

In order to determine flow rate, pressure information may be employed. Accordingly, although pressure is used in the illustrated embodiment, other fluid properties may be obtained such as temperature. Pressure data may be taken from the first sensor 503, second sensor 505 in one or more of the plurality of zones isolated by the zonal isolation packers 26. Further, pressure data may be taken from the third sensor 507 in one or more of the respective plurality of production zones. A differential pressure based on the difference between the pressure data from the first sensor 503 and the pressure data from the second sensor 505 may be obtained and flow rate determined in the respective production zones. Additionally, a second differential pressure based on a difference between the pressure data from the second sensor 505 and the pressure data from the third sensor 507. A fluid flow rate from the corresponding production zone may also be determined based on first differential pressure and the second differential pressure. In at least one example, the method can obtain pressure from the first sensor 503, second sensor 505, and third sensor 507 substantially simultaneously. As used herein substantially simultaneously can include within one second, with one minute or within one hour. In at least one example, substantially simultaneously can be within one second or less.

Figure 12:
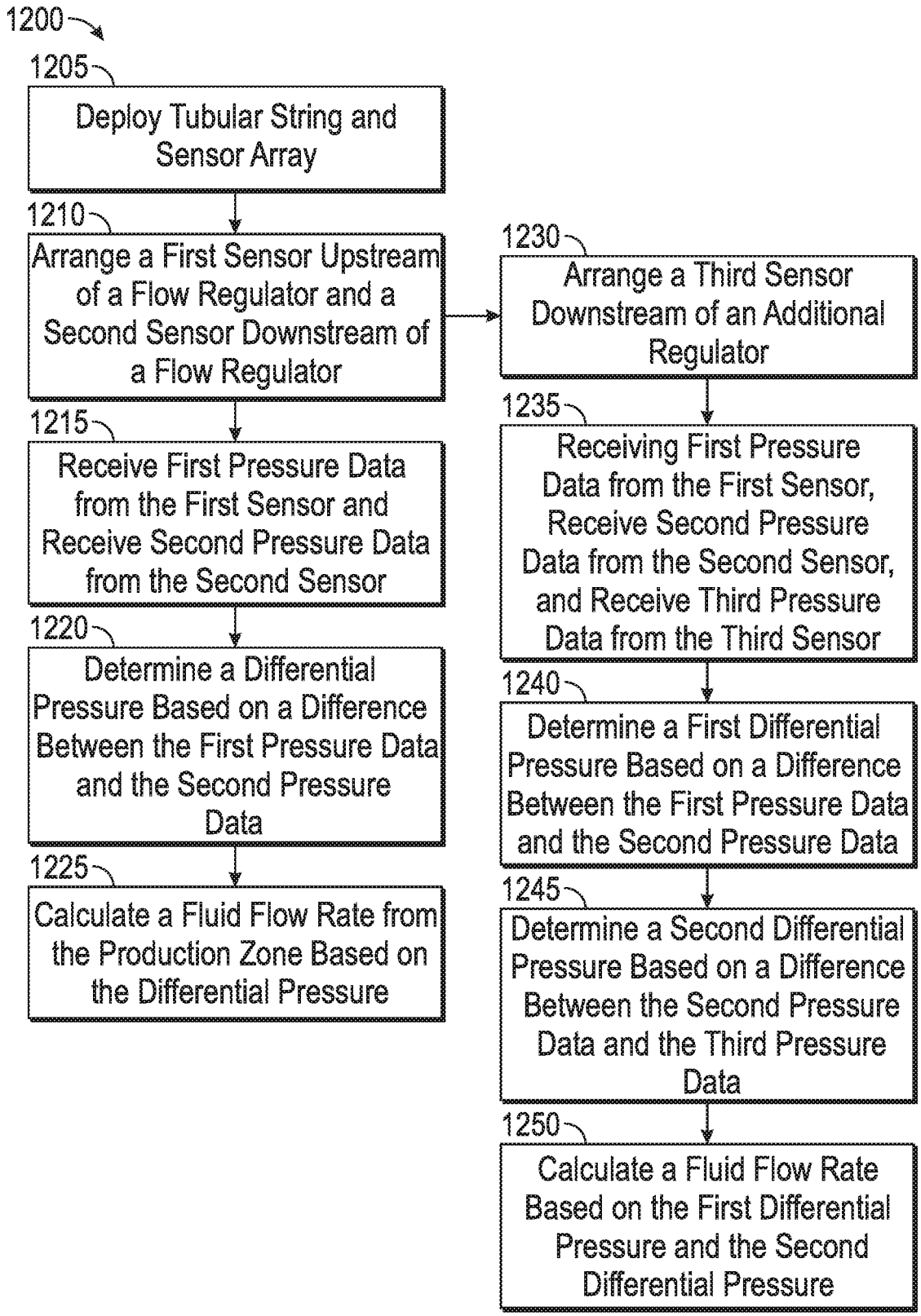
FIG. 12 is a flow diagram for calculating flow rate from a production zone.

FIG. 12 is a flow diagram of flow 1200 illustrating calculating a flow rate using the array of sensors disclosed herein. As shown in step 1205, a tubular string is deployed with a sensor array. A first sensor and second sensor of the sensor array can be arranged in one or a plurality of production zones. In step 1210, a first sensor is arranged upstream of a flow regulator and a second sensor is arranged downstream of a flow regulator. Generally, the fluid produced from the formation flows through the flow regulator and into the tubular string. In step 1215, first pressure data is received from a first sensor and second pressure data is received from a second sensor. In step 1220, a differential pressure is determined based on the difference between the first pressure data and the second pressure data. Next, in step 1225, a fluid flow rate from the production zone is calculated based on the differential pressure. This can be carried out in a production zone or a plurality of production zones.

Following step 1210, an alternative or additional flow is shown beginning with step 1230, where a third sensor is arranged downstream of an additional flow regulator. In step 1235, first pressure data may be obtained by the first sensor, second pressure data may be obtained from the second sensor, and third pressure data may be obtained from the third sensor. In step 1240, a first differential pressure may be obtained based on the difference between the first pressure data and the second pressure data. In step 1245, a second pressure differential may be obtained between the second pressure data and the third pressure data. Next, in step 1250, a flow rate from the production zone may be calculated based on the first differential pressure and the second differential pressure. This can be carried out in a production zone or a plurality of production zones.

In addition to the above, an array of sensors, and in particular a spoolable array of sensors, may be used to measure the profile, such as a pressure profile, in another non-flowing wellbore. This array of sensors is used to monitor the stimulation treatments in nearby wellbores. The monitoring wellbore, which is the wellbore having the sensor array, has no production flow. As a result, all of the pressure variations can be attributed to the effects from the stimulation treatments in the nearby wellbores. Therefore, by detecting such variations, the nearby wellbores can be monitored and evaluated.

Figure 13:
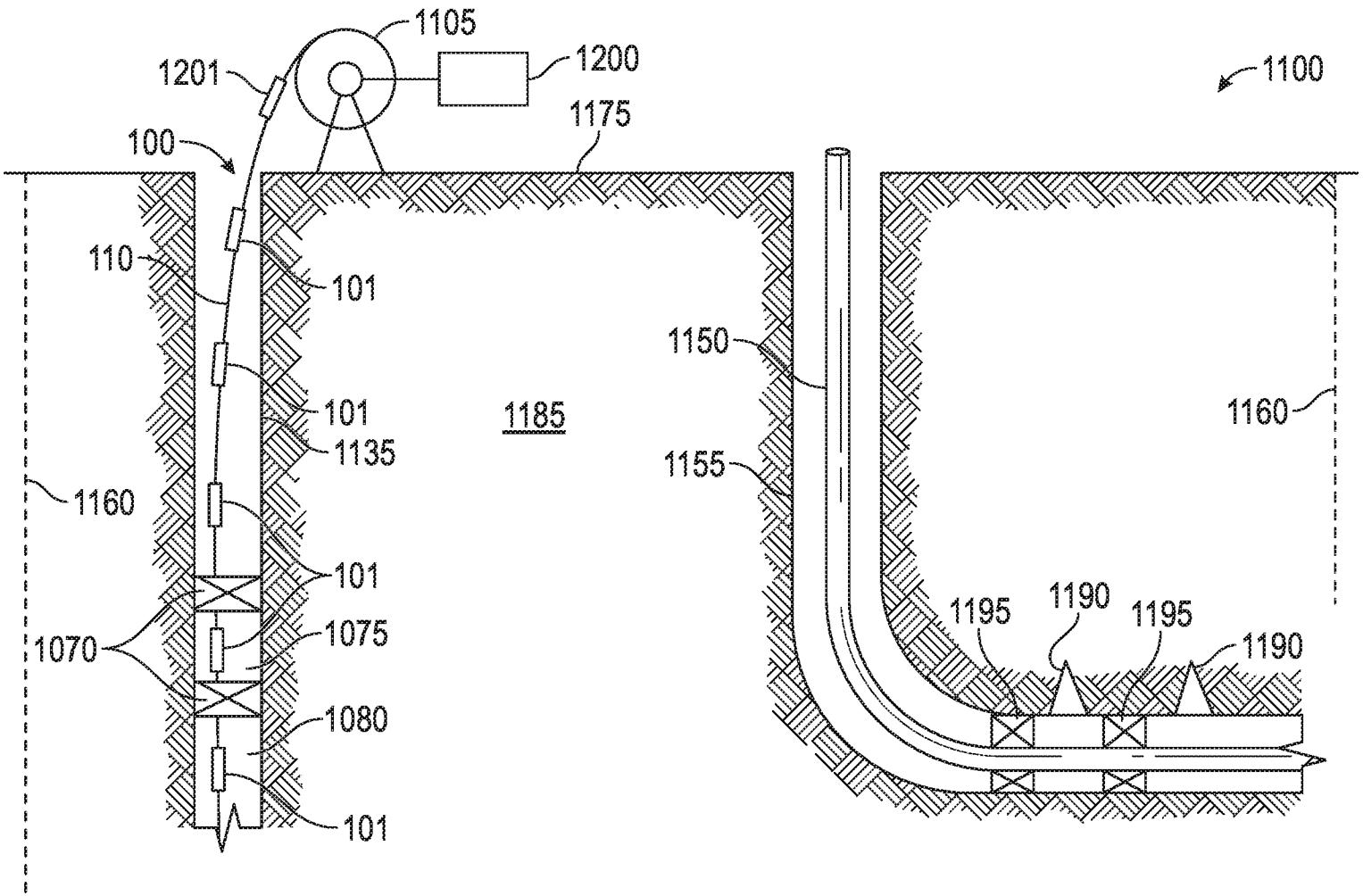
FIG. 13 is a schematic diagram of a spoolable sensor array for monitoring an adjacent wellbore in an oilfield.

FIG. 13 is a schematic of an environment for implementation of the disclosure herein having oilfield 1100. As illustrated, the environment includes a monitoring well 1135. Although a monitoring well 1135 is illustrated in FIG. 13, the present disclosure may be implemented in a well with no production, flow, or injection, and may operate equally as well without packers, isolated zones, as well as in alternative phases of a well under completion. As shown, an array of sensors 100 is spoolable from spool 1105. The array of sensors 100 is shown as having a line 110 which connect each of the individual sensors 101. The line 110 may be a cord, line, metal, TEC, and may be conductive and permit power and data to transfer over the line 110 between each of the sensors 101 and to the surface. In at least one example, the line 110 can include an optical fiber. The line 110 may be sufficiently ductile to permit spooling and some amount of bending, but also be sufficiently rigid to hold a particular shape in the absence of external force. Data from the array may be provided to a processor at the surface 1175, such as device 1200 discussed further below. The sensors 101 of the array of sensors 100 may be pressure and/or temperature sensors.

The array of sensors 100 is deployed into wellbore 1135, which extends into the subterranean earth 1185 which may have various formations and hydrocarbon reservoirs. There may be no flow in the monitoring wellbore 1135. However, there could be flow at different times and little to no flow at other times. The array of sensors 100 allows for temperature and/or for pressure monitoring of adjacent (e.g. nearby) wellbores such as wellbore 1155, which may be under various phases, such as stimulation treatments. Stimulation treatments include fracture monitoring, injection treatments, and other stimulation operations. As illustrated is wellbore 1155 having tubular string 1150. In at least one example, the tubular string 1150 can be at least one of a production string, production tubing, or casing. The tubular string 1150 may be made up of a number of individual tubulars, also referred to as sections or joints. In at least one example, the tubular string 1150 is production string or tubing as the present disclosure allows for monitoring of the production. The wellbore 1155 may have fractures 1190 as well as packers 1195 for isolating particular zones.

Observing the measurements from the array of sensors 100, and in particular pressure measurements when the array of sensors 100 are pressure sensors, in wellbore 1135 allows an operator to determine a status or property of an adjacent wellbore such as wellbore 1155, to determine whether there is cross-well interference, whether unwanted zones are being stimulated, or how the stimulation treatment is progressing. Data from the sensors 101 along the line 110 may be provided to one or more processors at the surface, such as device 200 discussed further below. The device 200 may determine determining, based on the measurement, a wellbore state or property of an adjacent well, such as flow rate, or the status of a treatment such as completion. These measurements are also useful for debugging whatever may go wrong during a stimulation or other treatment. The measurements may be processed in the device 200 or displayed for an operator.

The wellbore 1135 may have sensors placed in isolated zones, such as zone 1070, which may be isolated with packers 1070. When done with a number of zones, the operator or processor may determine the pressure rise in each zone, such as zone 1080 and then zone 1075. Alternatively, in other applications, two or more sensors 101 can be positioned in an isolated zone such as zone 1075. Alternatively, the wellbore 1135 may be free of packers, isolated zones, or other equipment, and thus the array of sensors can be deployed freely.

The use of the array of sensors 101 allows for the substantially simultaneous measurement of the pressure within the wellbore. Substantially simultaneous measurements may assist in avoiding erroneous estimates such as from different stimulation events being an inherently time-varying operation. Substantially simultaneous may be defined precisely the same instant, or alternatively within a short time period, such as within 1 second, within 1 minute, or within 1 hour. The pressure measurements may be averaged over time or may be low-pass filtered to help remove noise.

The present disclosure also may be implemented with respect to various injections, such as perimeter injection. In perimeter injection, fluids (typically water/brine) are injected at the perimeter, such as perimeter 1160 of the oilfield 1100 with the intent of driving the oil (any type of hydrocarbon) towards producing wells in the interior of the oilfield 1100. The pressure profile provided by the array of pressure sensors can alert an operator (or customer) whether the some of the injector wells are injecting at the right flow rates or whether they are injecting at the at the correct depths.

In a monitoring wellbore completion, a sensor array is used to provide estimates of what is happening at a nearby wellbore. This cross-well evaluation of the formation provides useful understanding of the stimulation behavior.

Figure 14:
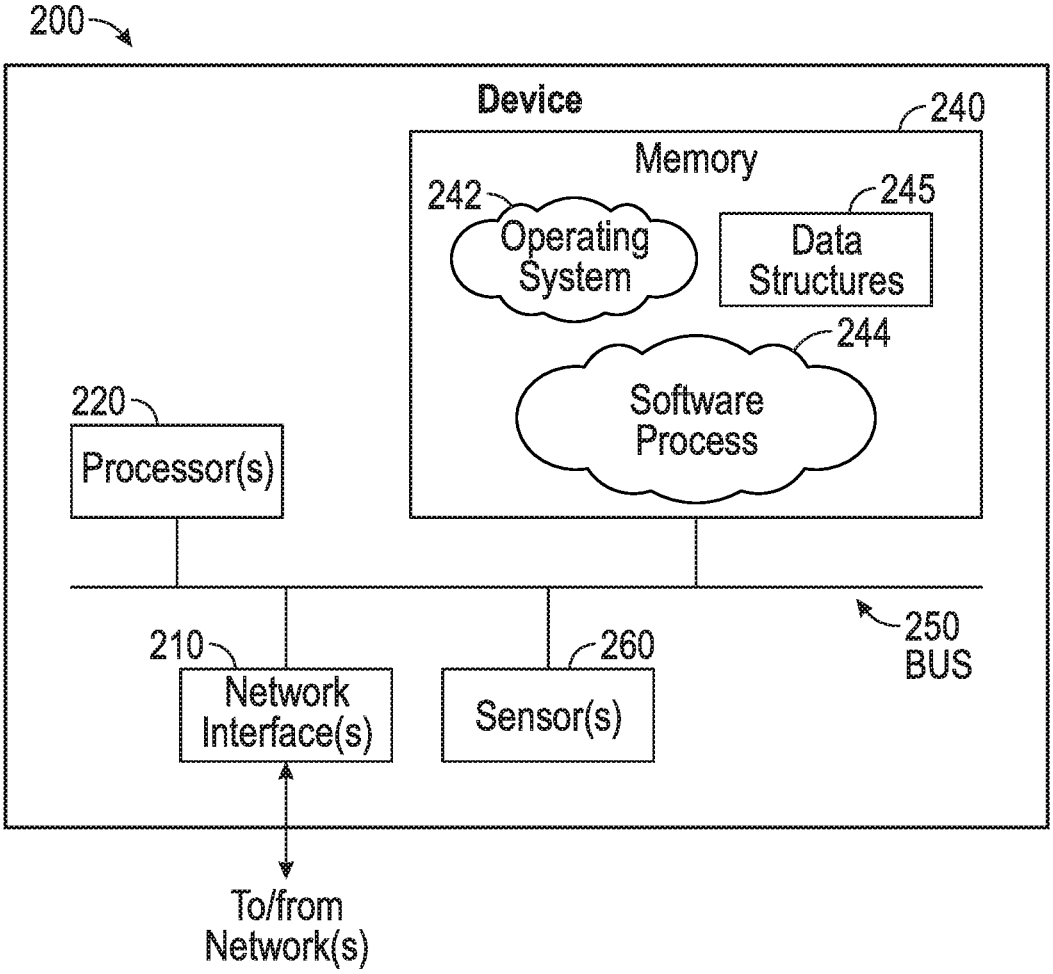
FIG. 14 is a schematic diagram of a processing device which may be employed with the disclosure herein.

FIG. 14 is a block diagram of an exemplary device 200. Device 200 is configured to perform processing of data and communicate with the sensors 101 of the array of sensors 100 in FIGS. 1, 4, 9, and 13. In operation, device 200 communicates with one or more of the above-discussed borehole components and may also be configured to communication with remote devices/systems.

As shown, device 200 includes hardware and software components such as network interfaces 210, at least one processor 220, sensors 260 and a memory 240 interconnected by a system bus 250. Network interface(s) 210 include mechanical, electrical, and signaling circuitry for communicating data over communication links, which may include wired or wireless communication links. Network interfaces 210 are configured to transmit and/or receive data using a variety of different communication protocols, as will be understood by those skilled in the art.

Processor 220 represents a digital signal processor (e.g., a microprocessor, a microcontroller, or a fixed-logic processor, etc.) configured to execute instructions or logic to perform tasks in a wellbore environment. Processor 220 may include a general purpose processor, special-purpose processor (where software instructions are incorporated into the processor), a state machine, application specific integrated circuit (ASIC), a programmable gate array (PGA) including a field PGA, an individual component, a distributed group of processors, and the like. Processor 220 typically operates in conjunction with shared or dedicated hardware, including but not limited to, hardware capable of executing software and hardware. For example, processor 220 may include elements or logic adapted to execute software programs and manipulate data structures 245, which may reside in memory 240.

Sensors 260, which may include the sensors 101 of the array of sensors 100 as disclosed herein, typically operate in conjunction with processor 220 to perform wellbore measurements, and can include special-purpose processors, detectors, transmitters, receivers, and the like. In this fashion, sensors 260 may include hardware/software for generating, transmitting, receiving, detection, logging, and/or sampling magnetic fields, seismic activity, and/or acoustic waves, or other well parameters.

Memory 240 comprises a plurality of storage locations that are addressable by processor 220 for storing software programs and data structures 245 associated with the embodiments described herein. An operating system 242, portions of which may be typically resident in memory 240 and executed by processor 220, functionally organizes the device by, inter alia, invoking operations in support of software processes and/or services 244 executing on device 200. These software processes and/or services 244 may perform processing of data and communication with device 200, as described herein. Note that while process/service 244 is shown in centralized memory 240, some embodiments provide for these processes/services to be operated in a distributed computing network.

It will be apparent to those skilled in the art that other processor and memory types, including various computer-readable media, may be used to store and execute program instructions pertaining to the borehole evaluation techniques described herein. Also, while the description illustrates various processes, it is expressly contemplated that various processes may be embodied as modules having portions of the process/service 244 encoded thereon. In this fashion, the program modules may be encoded in one or more tangible computer readable storage media for execution, such as with fixed logic or programmable logic (e.g., software/computer instructions executed by a processor, and any processor may be a programmable processor, programmable digital logic such as field programmable gate arrays or an ASIC that comprises fixed digital logic. In general, any process logic may be embodied in processor 220 or computer readable medium encoded with instructions for execution by processor 220 that, when executed by the processor, are operable to cause the processor to perform the functions described herein.

The embodiments shown and described above are only examples. Therefore, many details are neither shown nor described. Even though numerous characteristics and advantages of the present technology have been set forth in the foregoing description, together with details of the structure and function of the present disclosure, the disclosure is illustrative only, and changes can be made in the detail, especially in matters of shape, size and arrangement of the parts within the principles of the present disclosure to the full extent indicated by the broad general meaning of the terms used in the attached claims. It will therefore be appreciated that the embodiments described above can be modified within the scope of the present disclosure.

Statements of the Disclosure Include:

Statement 1: A method comprising: deploying a tubular string within a wellbore, the tubular string having a central flow passage and an external surface; deploying a spoolable sensor array, wherein the spoolable sensor array comprises a plurality of sensors and is coupled with the tubular string; measuring a property of a fluid within the tubular string with at least one sensor of the spoolable sensor array.

Statement 2: The method according to Statement 1, wherein the at least one sensor of the spoolable sensor array is connected via a conductive line with one or more other sensors of the spoolable sensor array.

Statement 3: The method according to Statement 1 or 2, wherein the tubular string along its length has a flow port extending from the central flow passage to the external surface, the method further comprising positioning the at least one sensor proximate the flow port sufficient to detect a property of the internal fluid within the central flow passage.

Statement 4: The method according to any one of preceding Statements 1-3, wherein the property is one or more of temperature, pressure, or flow rate.

Statement 5: The method according to any one of preceding Statements 1-4, wherein the tubular string along its length has a flow port extending from the central flow passage to the external surface, and the method further comprising: deploying a pair of isolation packers, the pair of isolation packers comprising a first isolation packer and a second isolation packer; and deploying a secondary packer between the pair of isolation packers, wherein at least one of the plurality of sensors is located between the first isolation packer and the secondary packer and at least one other of the plurality of sensors located between the second isolation packer and the secondary packer.

Statement 6: The method according to Statement 4, deploying the at least one secondary packer comprises locating the secondary packer over a flow regulator.

Statement 7: The method according to Statement 5 or 6, deploying the at least one secondary packer comprises locating the secondary packer over a flow regulator.

Statement 8: The method according to Statement 1, wherein at least one tubular of the tubular string having a property communication port extending from a central flow passage to the external surface; and the method further comprising: covering the property communication port with a shroud, and maintaining, via the shroud, at least one of the sensors of the array of sensors in a position proximate the property communication port sufficient to detect a property of an internal fluid within the central flow passage.

Statement 9: The method according Statement 8, wherein the shroud encloses both the sensor and the property communication port.

Statement 10: The method according to Statement 8 or 9, wherein the property communication port is an aperture in the tubular.

Statement 11: The method according to any one of preceding Statements 8-10, wherein the shroud is elastomeric.

Statement 12: The method according to any one of preceding Statements 8-11, wherein the shroud is coupled to the tubular with a seal, thereby sealing the property communication port.

Statement 13: A method comprising: deploying a tubular string within a wellbore, the tubular string having a central flow passage and an external surface; deploying a spoolable sensor array, comprising a plurality of sensors; coupling the spoolable sensor array including a plurality of sensors to the tubular string; deploying a pair of zonal isolation packers to isolate a production zone; wherein at least two sensors of the plurality of sensors of the spoolable sensor array are located within the production zone, a first one of the at least two sensors being located upstream from an initial flow regulator and a second one of the at least two sensors being located downstream from the initial flow regulator.

Statement 14: The method according to Statement 13, further comprising: receiving first pressure data, at a processor, from the first one of the at least two sensors; receiving second pressure data, at the processor, from the second one of the at least two sensors; determining, at the processor, a differential pressure based on a difference between the first pressure data and the second pressure data; calculating, at the processor, a fluid flow rate within the production zone based on the differential pressure.

Statement 15: The method according to Statement 13 or 14, further comprising deploying the first one of the at least two sensors on or proximate to a screen.

Statement 16: The method according to any one of preceding Statements 13-15, further comprising deploying the second one of the at least two sensors to have a fluidic coupling to the initial flow regulator measuring a property of the fluid exiting the initial flow regulator.

Statement 17: The method according to any one of preceding Statements 13-16, wherein a pair of secondary packers isolate a zone having the second one of the at least two sensors between the initial flow regulator and an additional flow regulator.

Statement 18: The method according to any one of preceding Statements 13-17, wherein a third sensor of the plurality of sensors is located downstream of an additional flow regulator, the additional flow regulator being downstream of the initial flow regulator.

Statement 19: The method according to any one of preceding Statements 13-18, further comprising: receiving first pressure data, at a processor, from the first one of the at least two sensors; receiving second pressure data, at the processor, from the second one of the at least two sensors; receiving third pressure data, at the processor, from the third sensor; determining, at the processor, a first differential pressure based on the difference between the first pressure data and the second pressure data; determining, at the processor, a second differential pressure based on a difference between the second pressure data and the third pressure data; and calculating, at the processor, a fluid flow rate from the corresponding production zone based on first differential pressure and the second differential pressure.

Statement 20: The method according to any one of preceding Statements 13-19, deploying a plurality of pairs of zonal isolation packers to isolate a corresponding number of production zones, wherein at least two of the plurality of sensors are located within the production zones; wherein the at least two of the plurality of sensors comprise a first sensor being located upstream from an initial flow regulator and a second sensor being located downstream from the initial flow regulator wherein the at least two of the plurality of sensors.

Statement 21: A method of monitoring nearby wellbores comprising: deploying an array of sensors in a non-producing wellbore, the array of sensors comprising a plurality of sensors attached along the length of a conductive line; obtaining, substantially simultaneously, a measurement by each of the sensors in the array of a downhole property of the wellbore; and determining, based on the measurement, a wellbore state or property of an adjacent well.

Statement 22: The method according to Statement 21, wherein the downhole property is one or more of temperature or pressure of the wellbore.

Statement 23: The method according to Statement 21 or 22, wherein substantially simultaneously is defined as obtaining a measurement by each of the sensors in the array of sensors within a time period of one minute.

Statement 24: The method according to any one of preceding Statements 21-23, wherein the adjacent well is under a stimulation treatment.

Statement 25: The method according to any one of preceding Statements 21-24, wherein the wellbore property of the adjacent well is a flow rate of a fluid in the adjacent well.

Statement 26: A system comprising: a tubular string positioned within a wellbore, the tubular string having a central flow passage and an external surface; and a spoolable sensor array provided along the tubular string, wherein the spoolable sensor array comprises a plurality of sensors and is coupled with the tubular string, the spoolable sensor array operable to measure a property of a fluid within the tubular string with at least one sensor of the spoolable sensor array.

Statement 27: The method according to Statement 26, wherein the at least one sensor of the spoolable sensor array is connected via a conductive line with one or more other sensors of the spoolable sensor array.

Statement 28: The method according to Statement 26 or 27, wherein the tubular string along its length has a flow port extending from the central flow passage to the external surface, the at least one sensor proximate the flow port sufficient to detect a property of the internal fluid within the central flow passage.

Statement 29: The method according to any one of preceding Statements 26-28, wherein the property is one or more of temperature, pressure, or flow rate.

Statement 30: The method according to any one of preceding Statements 26-29, wherein the tubular string along its length has a flow port extending from the central flow passage to the external surface, a pair of isolation packers, the pair of isolation packers comprising a first isolation packer and a second isolation packer; secondary packer located between the pair of isolation packers, wherein at least one of the plurality of sensors is located between the first isolation packer and the secondary packer and at least one other of the plurality of sensors located between the second isolation packer and the secondary packer; and a processor communicatively coupled to the spoolable sensor array and operable to obtain data from the plurality of sensors.

Statement 31: The method according to Statement 30, wherein the secondary packer is positioned over a flow regulator.

Statement 32: The method according to Statement 30 or 31, comprising at least one tubular of the tubular string having a property communication port extending from a central flow passage to the external surface; a shroud covering the property communication port, and maintaining, via the shroud, at least one of the sensors of the array of sensors in a position proximate the property communication port sufficient to detect a property of an internal fluid within the central flow passage.

Statement 33: The method according to any one of preceding Statements 30-32, wherein the shroud encloses both the sensor and the property communication port.

Statement 34: A system comprising a tubular having a central flow passage for an internal fluid and an external surface; at least one pair of zonal isolation packers operable to be coupled to the tubular and operable to create a production zone; a spoolable sensor array coupled to the tubular and having a plurality of sensors; at least one flow regulator, each of the at least one flow regulator corresponding to each pair of the at least one pair of zonal isolation packers, the at least one flow regulator coupled to the tubular and operable to allow fluid to flow from the external surface of the tubular to the central flow passage; and at least two of the plurality of sensors being located between a corresponding pair of the at least one pair of zonal isolation packers the at least two of the plurality of sensors comprising: a first sensor located upstream of an initial flow regulator of the at least one flow regulator; a second sensor located downstream of the initial flow regulator; a processor coupled to corresponding ones of the first sensor and the second sensor, the processor operable to determine a pressure differential between the corresponding first and second sensors.

Statement 35: The method according to Statement 34, wherein the processor is operable to calculate a fluid flow rate from the corresponding production zone based on the pressure differential.

Statement 36: The method according to Statement 34 or 35, further comprising an additional flow regulator, and the plurality of sensors further comprises a third sensor, wherein the third sensor is located downstream of the additional flow regulator, and wherein the processor is coupled to a third sensor and is operable to: determine an additional differential pressure between the corresponding second and third sensors; and calculate a fluid flow rate from the corresponding production zone based on the differential pressure and the additional differential pressure.

Statement 37: The method according to Statement 36, wherein a pair of secondary packers isolate a zone having the second sensor between the initial flow regulator and the additional flow regulator.

Statement 38: The method according to any one of preceding Statements 34-37, wherein the first sensor is deployed on or proximate to a screen.

Statement 39: The method according to any one of preceding Statements 34-38 further comprising the second sensor having a fluidic coupling to the initial flow regulator for measuring a property of the fluid exiting the initial flow regulator.

Statement 40: A system of monitoring nearby wellbores comprising: an array of sensors disposed in a non-producing wellbore, the array of sensors comprising a plurality of sensors attached along the length of a conductive line, the array of sensors operable to obtain, substantially simultaneously, a measurement by each of the sensors in the array of a downhole property of the wellbore; and a processor coupled with the array of sensors, and operable to determine, based on the measurement, a wellbore state or property of an adjacent well.

Statement 41: The method according to Statement 40; wherein the downhole property is one or more of temperature or pressure of the wellbore.

Statement 42: The method according to Statement 40 or 41; wherein substantially simultaneously is defined as obtaining a measurement by each of the sensors in the array of sensors within a time period of one minute.

Statement 43: A tubular string comprising a tubular having a central flow passage and an external surface; a spoolable sensor array coupled with the tubular, wherein the spoolable sensor array comprises a plurality of sensors and is coupled with the tubular string during deployment; the spoolable sensor array operable to measure a property of a fluid within the tubular string with at least one sensor of the spoolable sensor array.

Statement 44: The method according to Statement 43; wherein the at least one sensor of the spoolable sensor array is connected via a conductive line with one or more other sensors of the spoolable sensor array.

Statement 45: The method according to Statement 43 or 44; wherein the tubular string along its length has a flow port extending from the central flow passage to the external surface, the at least one sensor proximate the flow port sufficient to detect a property of the internal fluid within the central flow passage.

Statement 46: The method according to any one of preceding Statements 43-45; wherein the property is one or more of temperature, pressure, or flow rate.

Statement 47: The method according to any one of preceding Statements 43-46; wherein the tubular string along its length has a flow port extending from the central flow passage to the external surface, a pair of isolation packers, the pair of isolation packers comprising a first isolation packer and a second isolation packer; and a secondary packer located between the pair of isolation packers, wherein at least one of the plurality of sensors is located between the first isolation packer and the secondary packer and at least one other of the plurality of sensors located between the second isolation packer and the secondary packer.

Statement 48: The method according to Statement 47, wherein the secondary packer is positioned over a flow regulator.

Statement 49: The method according to Statement 47 or 48, wherein at least one tubular of the tubular string having a property communication port extending from a central flow passage to the external surface; a shroud coupled with the tubular, the shroud covering the property communication port and maintaining the sensor proximate the property communication port sufficient to detect a property of the internal fluid within the central flow passage.

Statement 50: The method according to any one of preceding Statements 47 to 49, wherein the shroud encloses both the sensor and the property communication port.

Statement 51: The method according to any one of preceding Statements 47 to 50, wherein the property communication port is an aperture in the tubular.

Statement 52: The method according to any one of preceding Statements 47 to 51, wherein the shroud is elastomeric.

Statement 53: The method according to any one of preceding Statements 47 to 52, wherein the shroud is coupled to the tubular with a seal, thereby sealing the property communication port.

Statement 54: A tubular string comprising: a tubular having a central flow passage for an internal fluid and an external surface; at least one pair of zonal isolation packers operable to be coupled to the tubular; a spoolable sensor array coupled to the tubular and having a plurality of sensors; at least one flow regulator, for each pair of the at least one pair of zonal isolation packers, coupled to the tubular and operable to allow fluid to flow from the external surface of the tubular to the central flow passage; and at least two of the plurality of sensors being located between a corresponding pair of the at least one pair of zonal isolation packers, the at least two of the plurality of sensors comprising a first sensor located upstream of an initial flow regulator of the at least one flow regulator; and a second sensor located downstream of the initial flow regulator.

Statement 55: The method according to Statement 54, wherein the first sensor is deployed on or proximate to a screen.

Statement 56: The method according to Statement 54 or 55, wherein a third sensor is located downstream of an additional flow regulator, the additional flow regulator being downstream of the initial flow regulator.

Statement 57: The method according to any one of preceding Statements 54-56, wherein the initial flow regulator is an inflow control device (ICD) and the additional flow regulator is an autonomous inflow control device (AICD).

Statement 58: The method according to any one of preceding Statements 54-57, wherein a pair of secondary packers isolate a zone having the second sensor between the initial flow regulator and the additional flow regulator.

Statement 59: The method according to any one of preceding Statements 54-58, wherein a plurality of pairs of zonal isolation packers coupled with the tubular to isolate a corresponding number of production zones, wherein at least two of the plurality of sensors are located within the production zones; wherein the at least two of the plurality of sensors comprise a first sensor being located upstream from an initial flow regulator and a second sensor being located downstream from the initial flow regulator.

Statement 60: The method according to any one of preceding Statements 54-59, wherein the initial flow regulator is one of an inflow control device (ICD), autonomous inflow control device (AICD), inflow control valve (ICV), choke, nozzle, baffle, restrictor, tube, or valve.

Statement 61: A method configured to calculate flow rate in a tubular string, the method comprising: deploying a tubular string within a wellbore, the tubular string having a central flow passage and an external surface; deploying a spoolable sensor array, comprising a plurality of sensors, along with the deployment of the tubular string; coupling the spoolable sensor array to the tubular string during deployment; deploying at least one pair of zonal isolation packers to isolate a production zone; wherein at least two of the plurality of sensors are located within the production zone, a first one of the at least two of the plurality of sensors being located upstream from a flow regulator and a second one of the at least two of the plurality of sensors being located downstream from the flow regulator.

Statement 62: The method according to Statement 61, wherein at least one of the plurality of sensors is a pressure sensors.

Statement 63: The method according to Statement 61 or 62, wherein the at least one of plurality of sensors is a combination pressure and temperature sensor.

Statement 64: The method according to any one of preceding Statements 61-63, wherein the flow regulator is one of an inflow control device (ICD), autonomous inflow control device (AICD), inflow control valve (ICV), choke, nozzle, baffle, restrictor, tube, or valve.

Statement 65: The method according to any one of preceding Statements 61-63, further comprising: receiving first pressure data, at a processor, from the first one of the at least two of the plurality of sensors; receiving second pressure data, at the processor, from the second one of the at least two of the plurality of sensors; determining, at the processor, a differential pressure based on a difference between the first pressure data and the second pressure data; calculating, at the processor, a fluid flow rate from the production zone based on the differential pressure.

Statement 66: A method for determining fluid flow rate across a plurality of production zones, the method comprising: deploying a tubular string within a wellbore, the tubular string having a central flow passage and an external surface, at least one tubular of the tubular string having a flow passage formed therein; deploying a spoolable sensor array, comprising a plurality of sensors, along with the deployment of the tubular string, coupling the spoolable sensor array to the tubular string during deployment; deploying a plurality of pairs of zonal isolation packers to isolate a corresponding number of production zones, wherein at least two of the plurality of sensors are located within the production zones; wherein the at least two of the plurality of sensors comprise a first sensor being located upstream from an initial flow regulator and a second sensor being located downstream from the initial flow regulator.

Statement 67: The method according to Statement 66, further comprising deploying the second sensor to have a fluidic coupling to the initial flow regulator.

Statement 68: The method according to Statement 66 or 67, further comprising deploying the first sensor on or proximate to a screen.

Statement 69: The method according to any one of preceding Statements 66-68, wherein the at least two of the plurality of sensors comprises a third sensor.

Statement 70: The method according to any one of preceding Statements 66-69, wherein the third sensor is located downstream of an additional flow regulator, which is downstream of the initial flow regulator.

Statement 71: The method according to any one of preceding Statements 66-70, wherein each of the plurality of production zones includes three sensors.

Statement 72: The method according to any one of preceding Statements 66-71, further comprising: receiving first pressure data, at a processor, from the first sensor in a respective one of the plurality of production zones; receiving second pressure data, at the processor, from the second sensor in a respective one of the plurality of production zones; receiving third pressure data, at the processor, from the third sensor in a respective one of the plurality of production zones; determining, at the processor, a first differential pressure based on the difference between the first pressure data and the second pressure data; determining, at the processor, a second differential pressure based on a difference between the second pressure data and the third pressure data; and calculating, at the processor, a fluid flow rate from the corresponding production zone based on first differential pressure and the second differential pressure.

Statement 73: The method according to any one of preceding Statements 66-72, wherein the first pressure data, second pressure data, and third pressure data are obtained substantially simultaneously.

Statement 74: The method according to any one of preceding Statements 66-72, wherein the respective first pressure data, second pressure data, and third pressure data for each respective zone is obtained substantially simultaneously across all of the plurality of production zones.

Statement 75: A tubular string comprising: a tubular having a central flow passage for an internal fluid and an external surface; at least one pair of zonal isolation packers operable to be coupled to the tubular; a spoolable sensor array coupled to the tubular and having a plurality of sensors; at least one flow regulator, for each pair of the at least one pair of zonal isolation packers, coupled to the tubular and operable to allow fluid to flow from the external surface of the tubular to the central flow passage; and at least two of the plurality of sensors being located between a corresponding pair of the at least one pair of zonal isolation packers, the at least two of the plurality of sensors comprising: a first sensor located upstream of an initial flow regulator of the at least one flow regulator; and a second sensor located downstream of the initial flow regulator.

Statement 76: The tubular string according to Statement 75, wherein the at least one flow regulator further comprises an additional flow regulator and the at least two of the plurality of sensors further comprises a third sensor.

Statement 77: The tubular string according Statement 76, wherein the third sensor is located downstream of the additional flow regulator.

Statement 78: The tubular string according to any one of preceding Statements 75-77, wherein the at least one pair of zonal isolation packers comprises a plurality of pairs of zonal isolation packers and each pair of the plurality of zonal isolation packers operable to establish a production zone within a wellbore.

Statement 79: The tubular string according to any one of preceding Statements 75-78, wherein the initial flow regulator is one of an inflow control device (ICD), autonomous inflow control device (AICD), inflow control valve (ICV), choke, nozzle, baffle, restrictor, tube, or valve.

Statement 80: The tubular string according to any one of preceding Statements 76-79, wherein the additional flow regulator is one of an inflow control device (ICD), autonomous inflow control device (AICD), inflow control valve (ICV), choke, nozzle, baffle, restrictor, tube, or valve.

Statement 81: The tubular string according to any one of preceding Statements 76-80, wherein the initial flow regulator is an inflow control device (ICD) and the additional flow regulator is an autonomous inflow control device (AICD).

Statement 82: The tubular string according to any one of preceding Statements 75-81, wherein at least one of the plurality of sensors are pressure sensors.

Statement 83: The tubular string according to any one of preceding Statements 75-82, wherein at least one of the plurality of sensors are a combination pressure and temperature sensor.

Statement 84: A system comprising: a tubular having a central flow passage for an internal fluid and an external surface; at least one pair of zonal isolation packers operable to be coupled to the tubular and operable to create a production zone; a spoolable sensor array coupled to the tubular and having a plurality of sensors; at least one flow regulator, for each pair of the at least one pair of zonal isolation packers, coupled to the tubular and operable to allow fluid to flow from the external surface of the tubular to the central flow passage; and at least two of the plurality of sensors being located between a corresponding pair of the at least one pair of zonal isolation packers the at least two of the plurality of sensors comprising: a first sensor located upstream of an initial flow regulator of the at least one flow regulator; a second sensor located downstream of the initial flow regulator; a processor coupled to corresponding ones of the first sensor and the second sensor, the processor operable to determine a pressure difference between the corresponding first and second sensors.

Statement 85: The system according to Statement 84, wherein the processor is operable to calculate a fluid flow rate from the corresponding production zone based on the pressure difference.

Statement 86: The system according to Statement 85 or 85, wherein the at least one flow regulator further comprises an additional flow regulator and the at least two of the plurality of sensors further comprises a third sensor.

Statement 87: The system according Statement 86, wherein the third sensor is located downstream of the additional flow regulator.

Statement 88: The system according to any one of preceding Statements 84-87, wherein the at least one pair of zonal isolation packers comprises a plurality of pairs of zonal isolation packers and each pair of the plurality of zonal isolation packers operable to establish a production zone within a wellbore.

Statement 89: The system according to any one of preceding Statements 86-88, wherein the processor is coupled to the third sensor and is operable to: determine an additional differential pressure between the corresponding second and third sensors; and calculate a fluid flow rate from the corresponding production zone based on the differential pressure and the additional differential pressure.

Statement 90: The system according to any one of preceding Statements 84-87, wherein the flow regulator is one of an inflow control device (ICD), autonomous inflow control device (AICD), inflow control valve (ICV), choke, nozzle, baffle, restrictor, tube, or valve.

Statement 91: The system according to any one of preceding Statements 86-90, wherein the additional flow regulator is one of an inflow control device (ICD), autonomous inflow control device (AICD), inflow control valve (ICV), choke, nozzle, baffle, restrictor, tube, or valve.

Statement 92: The system according to any one of preceding Statements 86-91, wherein the flow regulator is an inflow control device (ICD) and the additional flow regulator is an autonomous inflow control device (AICD).

Statement 93: The system according to any one of preceding Statements 86-92, wherein at least one of the plurality of sensors are pressure sensors.

Statement 94: The system according to any one of preceding Statements 86-93, wherein at least one of the plurality of sensors are a combination pressure and temperature sensor.

Statement 95: A method for obtaining measurement of fluid properties in a tubular string and an annulus, the method comprising: deploying a tubular string within a wellbore, the tubular string having a central flow passage and an external surface, at least one tubular of the tubular string having a flow passage formed therein; deploying a spoolable sensor array along with the deployment of the tubular string, wherein the spoolable sensor array comprises a plurality of sensors and is coupled to the tubular string during deployment; deploying at least one pair of zonal isolation packers to isolate a production zone; and deploying at least one secondary packer between the at least one pair of zonal isolation packers, wherein at least one of the plurality of sensors is located on either side of the at least one secondary packer.

Statement 96: The method according to Statement 95, wherein at least one of the plurality of sensors comprise a combination pressure and temperature sensor.

Statement 97: The method according to Statement 95 or 96, wherein the secondary packer separate a production zone of the tubular string from the flow passage formed in the at least one tubular.

Statement 98: The method according to any one of preceding Statements 95-97, wherein deploying the at least one secondary packer comprises locating the secondary packer over a flow regulator.

Statement 99: The method according to any one of preceding Statements 95-98, wherein the flow regulator is one of an inflow control device (ICD), autonomous inflow control device (AICD), inflow control valve (ICV), choke, nozzle, baffle, restrictor, tube, or valve.

Statement 100: A tubular string comprising: a tubular having an external surface and a central flow passage for an internal fluid; a pair of isolation packers, the pair of isolation packers comprising a first isolation packer and a second isolation packer; a spoolable sensor array coupled to the tubular and having a plurality of sensors; and a secondary packer located between the pair of isolation packers, wherein at least one of the plurality of sensors is located between the first isolation packer and the secondary packer and at least one other of the plurality of sensors located between the second isolation packer and the secondary packer.

Statement 101: The tubular string according to Statement 100, wherein the tubular forms a passage through the exterior surface between the first isolation packer and the secondary packer, whereby a sensor zone is formed.

Statement 102: The tubular string according to Statement 100 or 101, wherein at least one of the plurality of sensors is located within the sensor zone and is operable to detect properties of the internal fluid within the central flow passage.

Statement 103: The tubular string according to any one of preceding Statements 100-102, wherein the plurality of sensors are located in an annulus formed between the external surface and a casing.

Statement 104: The tubular string according to any one of preceding Statements 100-103, wherein the one of the plurality of sensors is located substantially close to the passage.

Statement 105: The tubular string according to any one of preceding Statements 100-104, wherein the one of the plurality of sensors is located over the passage.

Statement 106: The tubular string according to any one of preceding Statements 100-105, wherein at least one of the plurality of sensors is located within the sensor zone and is operable to detect properties of the internal fluid within the central flow passage and wherein at least one other of the plurality of sensors is located in a production zone and is operable to detect properties of fluid external to the external surface of the tubular.

Statement 107: The tubular string according to any one of preceding Statements 100-106, wherein the tubular includes a flow regulator and the secondary packer is placed over the flow regulator.

Statement 108: The tubular string according to any one of preceding Statements 100-107, wherein at least one one of plurality of sensors is located within a sensor zone and measures properties of flow of fluid through the flow regulator into the passage, thereby providing a measurement of the properties of the internal fluid within the central flow passage, and wherein at least one other of the plurality of sensors is located in a production zone and is operable to measure properties of the fluid within an annulus between the external surface of the tubular and a casing.

Statement 109: A system comprising: a tubular string operable to be deployed in a wellbore, the tubular string having an external surface and a central flow passage for passage of an internal fluid; a pair of zonal isolation packers operable to be coupled to the tubular string; a spoolable sensor array coupled to the tubular string and having a plurality of sensors; at least one secondary packer located between the pair of zonal isolation packers, wherein one of the plurality of sensors is located between one of the pair of zonal isolation packers and the secondary packer and another of the plurality of sensors located between another of the pair of zonal isolation packers and the secondary packer; and a device coupled to the spoolable sensor array and operable to obtain data from the plurality of sensors.

Statement 110: The system according to Statement 109, wherein the tubular string forms a passage through the exterior surface between the first isolation packer and the secondary packer, whereby a sensor zone is formed.

Statement 111: The system according to Statement 109 or 110, wherein at least one of the plurality of sensors is located within the sensor zone and is operable to detect properties of the internal fluid within the central flow passage.

Statement 112: The system according to any one of preceding Statements 109-111, wherein the plurality of sensors are a combination pressure and temperature sensor.

Statement 113: The system according to any one of preceding Statements 109-112, wherein the at least one secondary packer is located over a flow regulator.

Statement 114: 20. The system according to any one of preceding Statements 109-113, wherein the flow regulator is one of an inflow control device (ICD), autonomous inflow control device (AICD), inflow control valve (ICV), choke, nozzle, baffle, restrictor, tube, or valve.

Statement 115: A tubular string comprising: a tubular having a central flow passage for an internal fluid and an external surface; a property communication port along a length of the tubular extending from the central flow passage to the external surface; a sensor; and a shroud coupled with the tubular, the shroud covering the property communication port and maintaining the sensor proximate the property communication port sufficient to detect a property of the internal fluid within the central flow passage.

Statement 116: The tubular string according to Statement 115, wherein the shroud encloses both the sensor and the property communication port.

Statement 117: The tubular string according to Statement 115 or 116, wherein the property communication port is an aperture in the tubular.

Statement 118: The tubular string according to any one of preceding Statements 115-117, wherein the shroud is coupled to the tubular with a seal, thereby sealing the property communication port.

Statement 119: The tubular string according to any one of preceding Statements 115-118, wherein the shroud covers a portion of the sensor.

Statement 120: The tubular string according to any one of preceding Statements 115-119, wherein the shroud is elastomeric.

Statement 121: The tubular string according to any one of preceding Statements 115-120, wherein the shroud is a rigid or semi-rigid housing.

Statement 122: The tubular string according to any one of preceding Statements 115-121, wherein the shroud comprises a clamping portion for coupling with the tubular.

Statement 123: The tubular string according to any one of preceding Statements 115-122, wherein the sensor is one of an array of sensors connected via a conductive line.

Statement 124: The tubular string according to any one of preceding Statements 115-123, wherein a second sensor of the array of sensors lies outside of the shroud.

Statement 125: The tubular string according to any one of preceding Statements 115-124, wherein the line extends to a surface processing unit.

Statement 126: The tubular string according to any one of preceding Statements 115-125, wherein the sensor is at least one of a temperature or pressure sensor.

Statement 127: A method comprising: deploying a tubular string within a wellbore, the tubular string having a central flow passage and an external surface, at least one tubular of the tubular string having a property communication port extending from a central flow passage to the external surface; spooling an array of sensors with the deploying tubular string; covering the property communication port with a shroud, and maintaining, via the shroud, at least one of the sensors of the array of sensors in a position proximate the property communication port sufficient to detect a property of an internal fluid within the central flow passage.

Statement 128: The method according to Statement 127, wherein the shroud wherein the property communication port is an aperture.

Statement 129: The method according to Statement 127 or 128, wherein the shroud wherein the property communication port is pre-machined.

Statement 130: The method according to any one of preceding Statements 127-129, wherein the shroud encloses both the sensor and the property communication port.

Statement 131: The method according to any one of preceding Statements 127-130, wherein the shroud is coupled to the tubular with a seal, thereby sealing the property communication port.

Statement 132: The method according to any one of preceding Statements 127-131, wherein the shroud covers a portion of the sensor.

Statement 133: The method according to any one of preceding Statements 127-132, wherein the shroud is elastomeric.

Statement 134: The method according to any one of preceding Statements 127-133, wherein the shroud is a rigid or semi-rigid housing.

Statement 135: The method according to any one of preceding Statements 127-134, wherein the shroud comprises a clamping portion for coupling with the tubular.

Statement 136: The method according to any one of preceding Statements 127-135, wherein a second sensor of the array of sensors lies outside of the shroud.

Statement 137: A system comprising: a tubular string deployed in a wellbore, the tubular string having a central flow passage for passage of an internal fluid and an external surface; at least one of the tubulars of the tubular string having a property communication port along the length of the tubular extending from the central flow passage to the external surface; an array of sensors connected via a line deployed in the wellbore; and a shroud coupled with the tubular, the shroud covering the property communication port and maintaining the sensor proximate the property communication port sufficient to detect a property of an internal fluid within the central flow passage.

Statement 138: The system according to Statement 137, wherein the shroud encloses both the sensor and the property communication port.

Statement 139: The system according to Statement 137 or 138, wherein the property communication port is an aperture in the tubular.

Statement 140: The system according to any one of preceding Statements 137-139, wherein the shroud is coupled to the tubular with a seal, thereby sealing the property communication port.

Statement 141: The system according to any one of preceding Statements 137-140, wherein the shroud covers a portion of the sensor.

Statement 142: The system according to any one of preceding Statements 137-141, wherein the shroud is elastomeric.

Statement 143: The system according to any one of preceding Statements 137-142, wherein the shroud is a rigid or semi-rigid housing.

Statement 144: The system according to any one of preceding Statements 137-143, wherein the shroud comprises a clamping portion for coupling with the tubular.

Statement 145: The system according to any one of preceding Statements 137-144, wherein the sensor is one of an array of sensors along the length of a line.

Statement 146: The system according to any one of preceding Statements 137-145, wherein the line extends to a surface processing unit.

Statement 147: The system according to any one of preceding Statements 137-146, wherein a second sensor of the array of sensors lies outside of the shroud.

Statement 148: The system according to any one of preceding Statements 137-147, wherein the sensor is at least one of a temperature or pressure sensor.

Statement 149: A method of monitoring nearby wellbores, the method comprising: deploying an array of sensors in a non-producing wellbore, the array of sensors comprising a plurality of sensors attached along the length of a conductive line; obtaining, substantially simultaneously, a measurement by each of the sensors in the array of a downhole property of the wellbore; and determining, based on the measurement, a wellbore state or property of an adjacent well.

Statement 150: The method according to Statement 149, wherein the downhole property is a pressure of the wellbore.

Statement 151: The method according to Statement 149 or 150, wherein the downhole property is a temperature.

Statement 152: The method according to any one of preceding Statements 149-151, wherein substantially simultaneously is defined as obtaining a measurement by each of the sensors in the array of sensors within a time period of one second.

Statement 153: The method according to any one of preceding Statements 149-152, wherein substantially simultaneously is defined as obtaining a measurement by each of the sensors in the array of sensors within a time period of one minute.

Statement 154: The method according to any one of preceding Statements 149-153, wherein substantially simultaneously is defined as obtaining a measurement by each of the sensors in the array of sensors within a time period of one hour.

Statement 155: The method according to any one of preceding Statements 149-154, wherein the adjacent well is under a stimulation treatment.

Statement 156: The method according to any one of preceding Statements 149-155, wherein the wellbore state of the adjacent well is a status of a stimulation process in the adjacent well.

Statement 157: The method according to any one of preceding Statements 149-156, wherein the wellbore property of the adjacent well is a flow rate of a fluid in the adjacent well.

Statement 158: The method according to any one of preceding Statements 149-157 further comprising, prior to obtaining a measurement, conducting a field perimeter injection, wherein the wellbore and the adjacent wellbores are within the perimeter of the field.

What is claimed is:

1. A method comprising:

deploying a tubular string within a wellbore, the tubular string having a central flow passage and an external surface;

deploying a spoolable sensor array, wherein the spoolable sensor array comprises a plurality of sensors and is coupled with the tubular string;

measuring a property of a fluid within the tubular string with at least one sensor of the spoolable sensor array, wherein the tubular string along its length has a flow port extending from the central flow passage to the external surface;

deploying a pair of isolation packers, the pair of isolation packers comprising a first isolation packer and a second isolation packer; and deploying a secondary packer between the pair of isolation packers, wherein at least one of the plurality of sensors is located between the first isolation packer and the secondary packer and at least one other of the plurality of sensors located between the second isolation packer and the secondary packer, wherein deploying the at least one secondary packer comprises locating the secondary packer over a flow regulator.

2. The method of claim 1, wherein the at least one sensor of the spoolable sensor array is connected via a conductive line with one or more other sensors of the spoolable sensor array.

3. The method of claim 1, wherein the tubular string along its length has a flow port extending from the central flow passage to the external surface, the method further comprising positioning the at least one sensor proximate the flow port sufficient to detect a property of the internal fluid within the central flow passage.

4. The method of claim 1, wherein the property is one or more of temperature, pressure, or flow rate.

5. The method as recited in claim 1, wherein the flow regulator is one of an inflow control device (ICD), autonomous inflow control device (AICD), inflow control valve (ICV), choke, nozzle, baffle, restrictor, tube, or valve.

6. A method comprising:

deploying a tubular string within a wellbore, the tubular string having a central flow passage and an external surface;

deploying a spoolable sensor array, comprising a plurality of sensors;

coupling the spoolable sensor array including a plurality of sensors to the tubular string;

deploying a pair of zonal isolation packers to isolate a production zone wherein at least two sensors of the plurality of sensors of the spoolable sensor array are located within the production zone, a first one of the at least two sensors being located upstream from an initial flow regulator and a second one of the at least two sensors being located downstream from the initial flow regulator; and deploying the second one of the at least two sensors to have a fluidic coupling to the initial flow regulator measuring a property of the fluid exiting the initial flow regulator.

7. The method as recited in claim 6, further comprising:

receiving first pressure data, at a processor, from the first one of the at least two sensors;

receiving second pressure data, at the processor, from the second one of the at least two sensors;

determining, at the processor, a differential pressure based on a difference between the first pressure data and the second pressure data;

calculating, at the processor, a fluid flow rate within the production zone based on the differential pressure.

8. The method as recited in claim 6, further comprising deploying the first one of the at least two sensors on or proximate to a screen.

9. The method as recited in claim 6, wherein a pair of secondary packers isolate a zone having the second one of the at least two sensors between the initial flow regulator and an additional flow regulator.

10. The method as recited in claim 6, wherein a third sensor of the plurality of sensors is located downstream of an additional flow regulator, the additional flow regulator being downstream of the initial flow regulator.

11. The method as recited in claim 10, further comprising:

receiving first pressure data, at a processor, from the first one of the at least two sensors;

receiving second pressure data, at the processor, from the second one of the at least two sensors;

receiving third pressure data, at the processor, from the third sensor;

determining, at the processor, a first differential pressure based on the difference between the first pressure data and the second pressure data;

determining, at the processor, a second differential pressure based on a difference between the second pressure data and the third pressure data; and calculating, at the processor, a fluid flow rate from the corresponding production zone based on first differential pressure and the second differential pressure.

12. A system comprising:

a tubular string positioned within a wellbore, the tubular string having a central flow passage and an external surface; and a spoolable sensor array provided along the tubular string, wherein the spoolable sensor array comprises a plurality of sensors and is coupled with the tubular string, the spoolable sensor array operable to measure a property of a fluid within the tubular string with at least one sensor of the spoolable sensor array, wherein the tubular string along its length has a flow port extending from the central flow passage to the external surface;

a pair of isolation packers, the pair of isolation packers comprising a first isolation packer and a second isolation packer;

a secondary packer located between the pair of isolation packers, wherein at least one of the plurality of sensors is located between the first isolation packer and the secondary packer and at least one other of the plurality of sensors located between the second isolation packer and the secondary packer; and a processor communicatively coupled to the spoolable sensor array and operable to obtain data from the plurality of sensors, wherein the secondary packer is positioned over a flow regulator.

13. The system of claim 12, wherein the at least one sensor of the spoolable sensor array is connected via a conductive line with one or more other sensors of the spoolable sensor array.

14. The system of claim 12, wherein the tubular string along its length has a flow port extending from the central flow passage to the external surface, the at least one sensor proximate the flow port sufficient to detect a property of the internal fluid within the central flow passage.

15. The system of claim 12, wherein the property is one or more of temperature, pressure, or flow rate.

16. A system comprising:

a tubular having a central flow passage for an internal fluid and an external surface;

at least one pair of zonal isolation packers operable to be coupled to the tubular and operable to create a production zone;

a spoolable sensor array coupled to the tubular and having a plurality of sensors;

at least one flow regulator, each of the at least one flow regulator corresponding to each pair of the at least one pair of zonal isolation packers, the at least one flow regulator coupled to the tubular and operable to allow fluid to flow from the external surface of the tubular to the central flow passage; and at least two of the plurality of sensors being located between a corresponding pair of the at least one pair of zonal isolation packers the at least two of the plurality of sensors comprising:

a first sensor located upstream of an initial flow regulator of the at least one flow regulator;

a second sensor located downstream of the initial flow regulator;

a processor coupled to corresponding ones of the first sensor and the second sensor, the processor operable to determine a pressure differential between the corresponding first and second sensors, wherein the processor is operable to calculate a fluid flow rate from the corresponding production zone based on the pressure differential;

an additional flow regulator, and the plurality of sensors further comprising a third sensor, wherein the third sensor is located downstream of the additional flow regulator, and wherein the processor is coupled to a third sensor and is operable to:

determine an additional differential pressure between the corresponding second and third sensors; and calculate a fluid flow rate from the corresponding production zone based on the differential pressure and the additional differential pressure.

17. The system as recited in claim 16, wherein a pair of secondary packers isolate a zone having the second sensor between the initial flow regulator and the additional flow regulator.

18. The system as recited in claim 16, wherein the first sensor is deployed on or proximate to a screen.

19. The system as recited in claim 16, further comprising the second sensor having a fluidic coupling to the initial flow regulator for measuring a property of the fluid exiting the initial flow regulator.

20. A tubular string comprising:

a tubular having a central flow passage and an external surface;

a spoolable sensor array coupled with the tubular, wherein the spoolable sensor array comprises a plurality of sensors and is coupled with the tubular string during deployment;

the spoolable sensor array operable to measure a property of a fluid within the tubular string with at least one sensor of the spoolable sensor array, wherein the tubular string along its length has a flow port extending from the central flow passage to the external surface;

a pair of isolation packers, the pair of isolation packers comprising a first isolation packer and a second isolation packer; and a secondary packer located between the pair of isolation packers, wherein at least one of the plurality of sensors is located between the first isolation packer and the secondary packer and at least one other of the plurality of sensors located between the second isolation packer and the secondary packer, wherein the secondary packer is positioned over a flow regulator.

21. The tubular string of claim 20, wherein the at least one sensor of the spoolable sensor array is connected via a conductive line with one or more other sensors of the spoolable sensor array.

22. The tubular string of claim 20, wherein the tubular string along its length has a flow port extending from the central flow passage to the external surface, the at least one sensor proximate the flow port sufficient to detect a property of the internal fluid within the central flow passage.

23. The tubular string of claim 20, wherein the property is one or more of temperature, pressure, or flow rate.

24. A tubular string comprising:

a tubular having a central flow passage for an internal fluid and an external surface;

at least one pair of zonal isolation packers operable to be coupled to the tubular;

a spoolable sensor array coupled to the tubular and having a plurality of sensors;

at least one flow regulator, for each pair of the at least one pair of zonal isolation packers, coupled to the tubular and operable to allow fluid to flow from the external surface of the tubular to the central flow passage; and at least two of the plurality of sensors being located between a corresponding pair of the at least one pair of zonal isolation packers, the at least two of the plurality of sensors comprising:

a first sensor located upstream of an initial flow regulator of the at least one flow regulator; and a second sensor located downstream of the initial flow regulator, wherein a third sensor is located downstream of an additional flow regulator, the additional flow regulator being downstream of the initial flow regulator.

25. The tubular string as recited in claim 24, wherein the first sensor is deployed on or proximate to a screen.

26. The tubular string as recited in claim 24, wherein the initial flow regulator is an inflow control device (ICD) and the additional flow regulator is an autonomous inflow control device (AICD).

27. The tubular string as recited in claim 24, wherein a pair of secondary packers isolate a zone having the second sensor between the initial flow regulator and the additional flow regulator.

28. The tubular string as recited in claim 24, a plurality of pairs of zonal isolation packers coupled with the tubular to isolate a corresponding number of production zones, wherein at least two of the plurality of sensors are located within the production zones;

wherein the at least two of the plurality of sensors comprise a first sensor being located upstream from an initial flow regulator and a second sensor being located downstream from the initial flow regulator.

29. The tubular string as recited in claim 24, wherein the initial flow regulator is one of an inflow control device (ICD), autonomous inflow control device (AICD), inflow control valve (ICV), choke, nozzle, baffle, restrictor, tube, or valve.

* * * * *